US010927632B2

(12) United States Patent
Lee et al.

(10) Patent No.: US 10,927,632 B2
(45) Date of Patent: Feb. 23, 2021

(54) DOWNHOLE WIRE ROUTING

(71) Applicant: HALLIBURTON ENERGY SERVICES, INC., Houston, TX (US)

(72) Inventors: Shao Hwa Lee, Singapore (SG); Hong Jin Lau, Singapore (SG); Mark S. Holly, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 216 days.

(21) Appl. No.: 16/069,030

(22) PCT Filed: Sep. 15, 2016

(86) PCT No.: PCT/US2016/051952

§ 371 (c)(1),
(2) Date: Jul. 10, 2018

(87) PCT Pub. No.: WO2018/052428

PCT Pub. Date: Mar. 22, 2018

(65) Prior Publication Data

US 2018/0371862 A1 Dec. 27, 2018

(51) Int. Cl.

| | |
|---|---|
| ***E21B 17/00*** | (2006.01) |
| ***E21B 33/072*** | (2006.01) |
| ***E21B 17/02*** | (2006.01) |
| ***E21B 23/14*** | (2006.01) |

(52) U.S. Cl.
CPC ..... *E21B 33/072* (2013.01); *E21B 17/023* (2013.01); *E21B 23/14* (2013.01); *E21B 17/003* (2013.01)

(58) Field of Classification Search
CPC ..... E21B 17/023–026; E21B 17/003
See application file for complete search history.

(56) References Cited

U.S. PATENT DOCUMENTS 2,440,245 A * 4/1948 Chevigny ..... H01J 19/36 165/80.4
2,946,926 A * 7/1960 Hawthorne ..... E21B 47/0905 361/248
3,518,608 A * 6/1970 Papadopoulos ..... E21B 17/003 439/191

(Continued)

FOREIGN PATENT DOCUMENTS

CN 102022109 A 4/2011
WO 2008137388 A1 11/2008

(Continued)

OTHER PUBLICATIONS

International Search Report and Written Opinion; PCT Application No. PCT/US2016/051952; dated Jun. 15, 2017.

(Continued)

*Primary Examiner* — Steven A MacDonald
(74) *Attorney, Agent, or Firm* — Polsinelli PC

(57) ABSTRACT

Downhole wire routing apparatus including a tubular body having an outer circumferential surface and a central bore extending along a longitudinal axis. The tubular body includes one or more channels, capable of receiving one or more wires, disposed within the tubular body between the central bore and outer circumferential surface. Method and system for routing wires to one or more downhole tools.

19 Claims, 26 Drawing Sheets

(56) References Cited

U.S. PATENT DOCUMENTS 3,860,742 A 1/1975 Medney
4,200,297 A * 4/1980 Tricon ..... E21B 17/025 166/242.5
4,202,087 A * 5/1980 Wilderman ..... E21B 19/24 166/243
4,337,969 A * 7/1982 Escaron ..... E21B 17/026 166/65.1
4,367,797 A * 1/1983 Brown ..... H01R 13/523 166/380
4,524,834 A * 6/1985 Barron ..... E21B 17/025 166/385
4,575,681 A * 3/1986 Grosso ..... E21B 17/003 324/347
4,660,635 A * 4/1987 Wittrisch ..... E21B 17/025 166/54.5
4,683,944 A 8/1987 Curlett
4,947,864 A 8/1990 Shockey et al.
5,334,801 A 8/1994 Mohn
5,394,823 A * 3/1995 Lenze ..... E21B 17/1035 166/105
6,367,845 B1 * 4/2002 Otten ..... F16L 7/00 285/119
6,619,392 B2 * 9/2003 Marangoni ..... E21B 17/1085 166/243
6,634,388 B1 * 10/2003 Taylor ..... B29C 63/34 138/104
6,670,880 B1 12/2003 Hall et al.
6,866,306 B2 3/2005 Boyle et al.
7,208,855 B1 * 4/2007 Floyd ..... E21B 43/128 166/66.4
7,261,155 B1 * 8/2007 Ward ..... E21B 17/025 166/117.5
7,377,315 B2 * 5/2008 Hall ..... E21B 47/01 166/242.1
9,200,486 B2 12/2015 Leveau et al.
9,366,092 B2 * 6/2016 Hutin ..... E21B 47/12
9,850,720 B2 * 12/2017 Richards ..... E21B 47/12
2002/0125008 A1 * 9/2002 Wetzel ..... A45C 13/02 166/278
2003/0221829 A1 * 12/2003 Patel ..... E21B 17/1035 166/278
2004/0168794 A1 * 9/2004 Vold ..... E21B 17/025 166/65.1
2004/0206511 A1 * 10/2004 Tilton ..... E21B 17/025 166/380
2004/0262013 A1 * 12/2004 Tilton ..... E21B 4/02 166/380
2005/0115717 A1 6/2005 Hall et al.
2005/0194185 A1 * 9/2005 Gleitman ..... G06F 17/40 175/45
2006/0289074 A1 * 12/2006 Eriksson ..... B23K 26/262 138/171
2007/0159351 A1 * 7/2007 Madhavan ..... E21B 17/003 340/855.1
2009/0038848 A1 * 2/2009 Garcia-Osuna ..... E21B 17/003 175/40
2009/0277652 A1 * 11/2009 Nutley ..... E21B 17/003 166/387
2010/0116550 A1 * 5/2010 Hutin ..... E21B 17/003 175/40
2010/0264646 A1 10/2010 Follini
2011/0006512 A1 * 1/2011 James ..... E21B 17/1035 285/45
2011/0192593 A1 * 8/2011 Roddy ..... E21B 33/13 166/250.01
2011/0232921 A1 * 9/2011 Hopmann ..... E21B 17/026 166/385
2011/0240372 A1 * 10/2011 Davis ..... E21B 10/32 175/263
2012/0217023 A1 * 8/2012 Chau ..... E21B 17/028 166/380
2013/0128697 A1 * 5/2013 Contant ..... E21B 17/028 367/81
2014/0055279 A1 * 2/2014 Hay ..... E21B 17/028 340/854.4
2014/0102806 A1 4/2014 Millet et al.
2014/0152458 A1 6/2014 Hiorth et al.
2014/0262513 A1 * 9/2014 Chau ..... E21B 17/003 175/40
2015/0007977 A1 * 1/2015 Lembcke ..... E21C 47/00 166/69
2017/0204680 A1 * 7/2017 Leismer ..... E21B 17/003

FOREIGN PATENT DOCUMENTS

WO 2009020784 A1 2/2009
WO 2015021106 A1 2/2015

OTHER PUBLICATIONS

English Abstract for CN 102022109 from Espacenet.
Gravdal et al., "Wired Drill Pipe Telemetry Enables Real-Time Evaluation of Kick during Managed Pressure Drilling"; SPE 132989; 2010.

* cited by examiner

DOWNHOLE WIRE ROUTING

CROSS-REFERENCE TO RELATED APPLICATIONS

This application is a national stage entry of PCT/US2016/051952 filed Sep. 15, 2016, said application is expressly incorporated herein in its entirety.

FIELD

The present disclosure relates to routing wires to tools in subterranean wellbores. In particular, the present disclosure relates to routing wires through tubular bodies coupled with downhole tools.

BACKGROUND

Wellbores are drilled into the earth for a variety of purposes including tapping into hydrocarbon bearing formations to extract the hydrocarbons for use as fuel, lubricants, chemical production, and other purposes. In order to facilitate processes and operations in the wellbore, various tools may be conveyed downhole. Wires may be coupled with downhole tools in order to transmit power to the tool as well as to convey telemetry data or control signals between the downhole tool and the surface.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
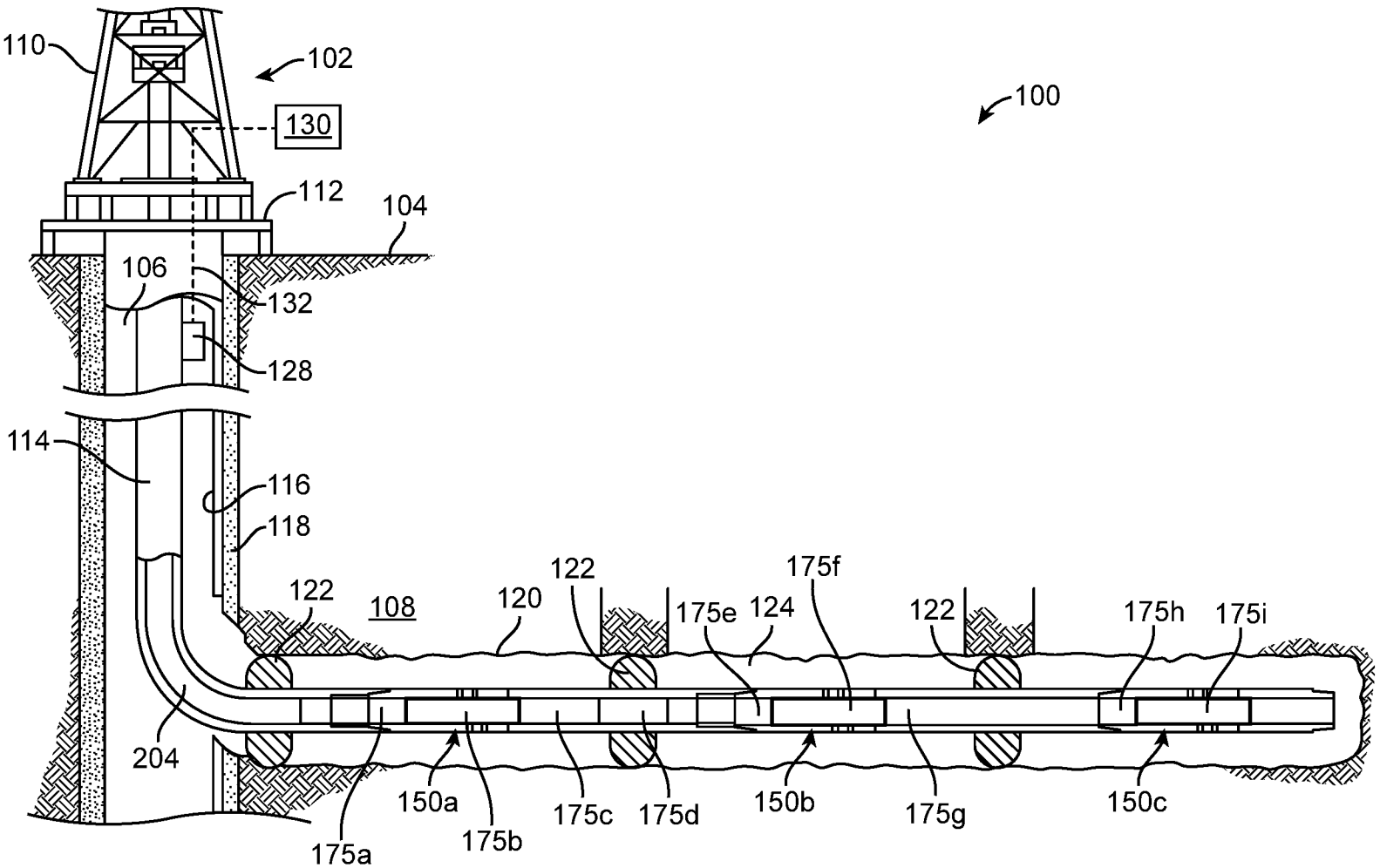
FIG. 1A is a schematic view of a wellbore operating environment in which one or more principles of the presently disclosed apparatus, method, and system may be employed or embodied, according to an exemplary embodiment.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed compositions and methods may be implemented using any number of techniques. The disclosure should in no way be limited to the illustrative implementations, drawings, and techniques illustrated herein, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "uphole" meaning toward the surface of the wellbore and with "down," "lower," "downward," "downstream," or "downhole" meaning toward the terminal end of the well, regardless of the wellbore orientation. The various characteristics described in more detail below, will be readily apparent to those skilled in the art with the aid of this disclosure upon reading the following detailed description, and by referring to the accompanying drawings.

The present disclosure generally relates to a downhole wire routing apparatus. The apparatus can include a tubular body having a central bore extending along a longitudinal axis and having an outer circumferential surface. The tubular body may further include one or more grooves, parallel to the longitudinal axis, within the tubular body between the central bore and outer circumferential surface. The grooves may form at least a portion of one or more channels capable of receiving one or more wires. The first end and/or the second end of the one or more channels may have an opening so as to provide an entry or exit path for a wire received in the channel. According to at least one aspect of the present disclosure, the opening of the end of the channel may be disposed about the central bore of the tubular body so as to provide communication between the channel and the central bore of the tubular body.

According to at least one aspect of the present disclosure, the tubular body of the wire routing apparatus may further include a cover that forms a portion of the outer circumferential surface of the tubular body and forms an upper portion of the one or more channels. A downhole tool may be coupled with the tubular body. According to at least one aspect of the present disclosure, a downhole tool may be disposed within the central bore of the tubular body. One or more wires may be received in the one or more channels of the tubular body.

According to at least one aspect of the present disclosure, the wire or wires may be routed to a downhole tool within the central bore of the tubular body through a port that connects the channels to the central bore. The wire or wires may be coupled with the downhole tool and may provide for the transmission of electrical power to the tool. The wires may also be configured to transmit telemetry data and/or control signals between the surface or a downhole computer and the downhole tool.

According to at least one aspect of the present disclosure, the tubular body included in the wire routing apparatus may further include a sealable aperture on the circumferential surface of the tubular body that provides access to the central bore of the tubular body from outside the tubular body. The sealable aperture may allow the wires received in the channels to be coupled with a downhole tool disposed in the central bore of the tubular body.

The present disclosure also relates to a method of routing a downhole wire to one or more downhole tools. The method includes deploying a downhole tool, coupled with at least one tubular body, within a wellbore. The tubular body may have an outer circumferential surface and a central bore extending along a longitudinal axis. The method further includes routing a wire through at least one tubular body to the downhole tool, where at least a portion of the wire is disposed within the at least one tubular body between the central bore and the outer circumferential surface. The method may further include transmitting through the wire electrical power, telemetry data, and/or a control signal.

According to at least one aspect of the present disclosure, the wire may be routed through one or more channels disposed in the tubular body between the central bore and the outer circumferential surface. The method may further include routing the wire to a downhole tool, disposed in the central bore of the tubular body, through a port that provides communication between the one or more channels and the central bore.

In some cases, the wire may be routed to the downhole tool from an oilfield surface adjacent the well. In other cases, the wire may be routed to the downhole tool from a downhole computing device. According to at least one aspect of the present disclosure, the method may further include performing at least one downhole tool operation.

According to at least one aspect of the present disclosure, the method may further include flowing hydraulic fluid through the one or more channels. The flowing of hydraulic fluid through the channels may include, at least in some instances, flowing hydraulic fluid between the wires received in a channel and the walls of the channel, in order to equalize the pressure within the channels so as to increase the survivability and service life of the downhole wire.

The present disclosure also relates to a system that includes a downhole tool provided in a wellbore and a tubular body coupled with the downhole tool. The tubular body includes an outer circumferential surface and a central bore extending along a longitudinal axis. The tubular body further includes one or more grooves, parallel to the longitudinal axis, disposed within the tubular body between the central bore and the outer circumferential surface. The one or more grooves form at least a portion of the one or more channels capable of receiving one or more wires. The first end and/or the second end of the one or more channels may have an opening so as to provide an entry or exit path for a wire received in the channel. According to at least one aspect of the present disclosure, the opening of the end of the channel is disposed about the central bore of the tubular body so as to provide communication between the channel and the central bore of the tubular body.

FIG. 1A illustrates a wellbore operating environment in which one or more principles of the presently disclosed apparatus, method, and system may be employed or embodied. As depicted, the operating environment 100 may include an oil and gas rig 102 arranged at the Earth's surface 104 and a wellbore 106 extending therefrom and penetrating a subterranean earth formation 108. The rig 102 may include a derrick 110 and a rig floor 112. The derrick 110 may support or otherwise help manipulate the axial position of a work string 114 extended within the wellbore 106 from the rig floor 112.

As used herein, the term "work string" refers to one or more types of connected lengths of tubulars as known in the art, and may include, but is not limited to, drill pipe, drill string, landing string, production tubing, casing, liners, combinations thereof, or the like. In other instances, the work string 114 may be or otherwise represent any other downhole conveyance means known to those skilled in the art, such as, but not limited to, coiled tubing, wireline, slickline, and the like, without departing from the spirit and scope of the present disclosure.

The work string 114 may be connected to the surface 104 and utilized in drilling, stimulating, completing, or otherwise servicing the wellbore 106, or various combinations thereof. As depicted in FIG. 1A, the wellbore 106 may extend substantially vertically away from the surface 104 over a vertical wellbore portion or may deviate at any angle from the surface 104 over a deviated or horizontal wellbore portion, without departing from the spirit and scope of the present disclosure. In other applications, portions or substantially all of the wellbore 106 may be vertical, deviated, horizontal, and/or curved. Consequently, the horizontal or vertical nature of the wellbore 106 should not be construed as limiting the present disclosure to any particular wellbore 106 configuration.

The wellbore 106 may be at least partially cased with a casing string 116 or may otherwise remain at least partially uncased. The casing string 116 may be secured into position within the wellbore 106 using, for example, cement 118. In some cases, the casing string 116 may be only partially cemented within the wellbore 106 or, alternatively, the casing string 116 may be entirely uncemented. A lower portion of the work string 114 may extend into a branch or lateral portion 120 of the wellbore 106. As depicted in FIG. 1A, the lateral portion 120 may be an uncased or "open hole" section of the wellbore 106.

The work string 114 may be arranged or otherwise seated within the lateral portion 120 of the wellbore 106 using one or more packers 122 or other wellbore isolation devices. The packers 122 may be configured to seal off an annulus 124 defined between the work string 114 and the walls of the wellbore 106. Accordingly, the subterranean formation 108 may be effectively divided into multiple intervals which may be stimulated and/or produced independently via isolation portions of the annulus 124 defined between adjacent pairs of packers 122. While only three intervals are shown in FIG. 1A, the operating environment 100 may include any number of intervals without departing from the scope and spirit of the present disclosure.

As shown in FIG. 1A, the operating environment 100 may include one or more tubular bodies 175 (shown as 175*a-i*) arranged in, coupled with, or otherwise forming an integral part of the work string 114. The tubular bodies 175 may be coupled with one or more downhole tools 150 (shown as 150*a*, 150*b*, and 150*c*) included in operating environment 100. In at least some instances, one or more downhole tools 150 may be disposed within the central bore of a tubular body 175. In such cases, the tubular body 175 may be, for instance, a housing enclosing a downhole tool. In other instances, the tubular body 175 may serve as a conduit or connecting member within work string 114. In such cases, tubular bodies 175 may provide a pathway for wire routing between one or more downhole tools 150 and a computer system 130 or similar device at the surface 104. Accordingly, control signals, telemetry data, and/or electrical power may be transmitted between downhole tools 150 and the surface 104 through wires routed, at least in part, through tubular bodies 175 according to one or more principles of the present disclosure. According to at least one aspect of the present disclosure, tubular bodies 175 may be a drill pipe, drill collar, or production pipe. As depicted in FIG. 1A, at least one downhole tool 150 may be arranged in each interval of the work string 114.

The operating environment 100 may further include at least one downhole computing device 128. As depicted in FIG. 1A, downhole computing device 128 is arranged within the flow path 204 of wellbore 106. In at least some cases, the downhole computing device 128 is in wired communication with at least one downhole tool 150 and in further communication with computer system 130 at the surface 104. The downhole computing device may be communicatively coupled with computer system 130 or the like arranged at the surface 104 via one or more communication lines 132. The communication line(s) 132 may be any wired or wireless means of telecommunication between two locations and may include, but is not limited to, electrical lines, fiber optic lines, radio frequency transmission, electromagnetic telemetry, an acoustic telemetry. In some cases, the downhole computing device 128 may form an integral part of the computer system 130.

While only one downhole computing device 128 is depicted in FIG. 1A, any number of downhole computing devices 128 may be used without departing from the spirit and scope of the present disclosure. Further, the downhole computing device 128 may be located at any location within wellbore 106, without departing from the spirit and scope of the present disclosure, so long as the downhole computing device 128 is in wired communication with at least one downhole tool 150. Additionally, the principles of the present disclosure may be practiced without the use of a downhole computing device 128. For instance, the downhole tool 150 may be in wired communication with the surface 104, for example, with computer system 130 at the surface 104, without being in communication with a downhole computing device 128.

As used herein, a "wire" means any wire capable of providing power or communication to a downhole tool, including, but not limited to, electrical wires, optical fibers, fiber optic cables, or the like. According to at least one aspect of the present disclosure, a "wire" may also include a hydraulic line or conduit capable of transmitting hydraulic fluid.

Figure 1B:
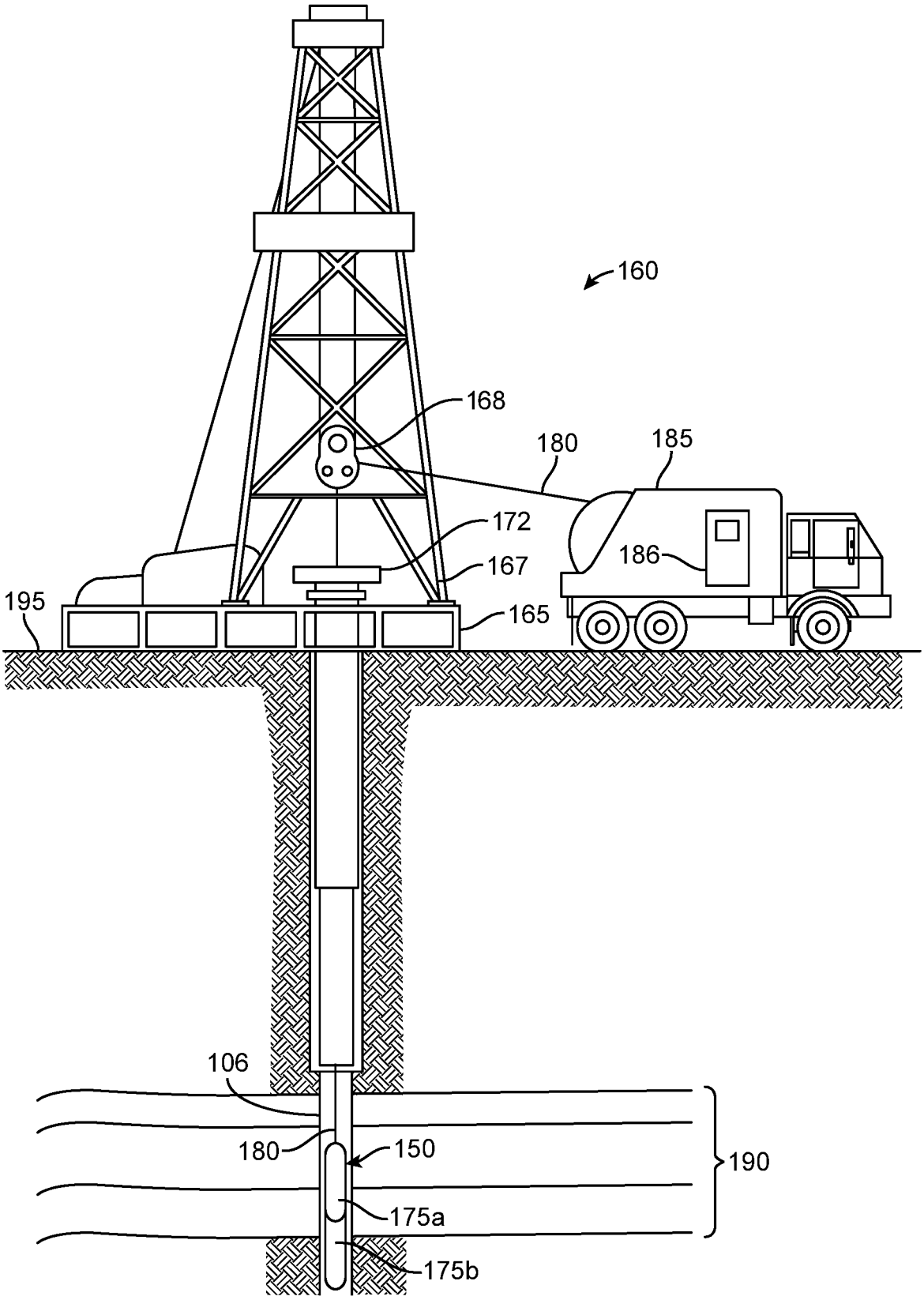
FIG. 1B is a schematic view of an additional wellbore operating environment in which one or more principles of the presently disclosed apparatus, method, and system may be employed or embodied, according to an exemplary embodiment.

FIG. 1B illustrates a wellbore operating environment in which one or more principles of the presently disclosed apparatus, method, and system may be employed or embodied. As depicted, the operating environment 160 includes a drilling platform 165 equipped with a derrick 167 that supports a hoist 168. Drilling oil and gas wells is commonly carried out using a string of drill pipes connected together so as to form a drilling string that is lowered through a rotary table 172 into a wellbore or borehole 106. Here it is assumed that the drill string has been temporarily removed from the wellbore 106 to allow a downhole tool 150 to be lowered into the wellbore 106. The downhole tool 150 may be conveyed in the wellbore 106 by any conveyance 180 including, but not limited to, wireline, logging cable, slickline, tubing, coiled tubing, pipe, metallic wire, non-metallic wire, or composite wire. Typically, the downhole tool 150 is lowered to into the wellbore 106 and subsequently used to perform operations adjacent to one or more subsurface formations 190 of interest. The downhole tool 150 is communicatively coupled with a control or processing facility 185 at the surface 195. The control or processing facility may include one or more control or processing units 186 capable of sending and receiving control signals and/or telemetry data to and from the downhole tool 150. In some cases, the downhole tool 150 may also receive power from the control or processing facility 185. In other cases, the downhole tool 150 receives power from a downhole power source, such as a battery.

As depicted in FIG. 1B, downhole tool 150, included in operating environment 160, may be coupled with one or more tubular bodies 175 (shown as 175*a* and 175*b*). In at least some instances, one or more downhole tools 150 may be disposed within the central bore of a tubular body 175. In such cases, tubular body 175 may, for instance, be a housing enclosing a downhole tool. In other instances, the tubular body 175 may serve as a conduit or connecting member between conveyance 180 and downhole tool 150. Tubular bodies 175 may provide a pathway for wire routing between one or more downhole tools 150 and a control or processing unit 186 or similar device at the surface 195. Accordingly, control signals, telemetry data, and/or electrical power may be transmitted between downhole tools 150 and the surface 104 through wires routed, at least in part, through tubular bodies 175 according to one or more principles of the present disclosure.

With reference to either FIG. 1A or FIG. 1B, the downhole tool 150 may include a variety of tools, devices, or machines that may be used in the preparation, stimulation, and production of the subterranean formation 108. In some cases, the downhole tool may include, but is not limited to, a sliding sleeve assembly, a fluid or core sampling device, a setting tool, a logging tool, a wellbore isolation device, a fishing tool, a milling tool, a drilling tool, a reamer, a packer, a perforating tool, and a bridge plug. In some cases, the downhole tool may be any downhole tool that includes at least one selected from a motor, a clutch, a downhole sensor, a valve, and an actuation device.

Although FIGS. 1A and 1B depict an onshore operation, the present disclosure is equally well-suited for use in offshore operations.

FIGS. 1A and 1B illustrate just exemplary wellbore operating environments in which the presently disclosed apparatus, method, and system may be deployed. According to at least one aspect of the present disclosure, the apparatus, method, and system may be deployed in other operating environments, such as a drilling environment. For instance, the tubular body 175 may be placed in a wellbore as part of a measurement while drilling (MWD) portion of a drillstring or as part of a logging while drilling (LWD) portion of a drillstring. In other instances, one or more tubular bodies 175 may be on a drillpipe as part of a wired drillpipe system. In such cases, control signals, telemetry data, and/or electrical power may be transmitted between downhole tools 150, such as MWD or LWD logging tools or sensors and directional drilling apparatus, and the surface 104 through wires routed, at least in part, through tubular bodies 175 according to one or more principles of the present disclosure. For example, according to at least one aspect of the present disclosure, tubular bodies 175 may be a drill pipe or drill collar.

Figure 2A:
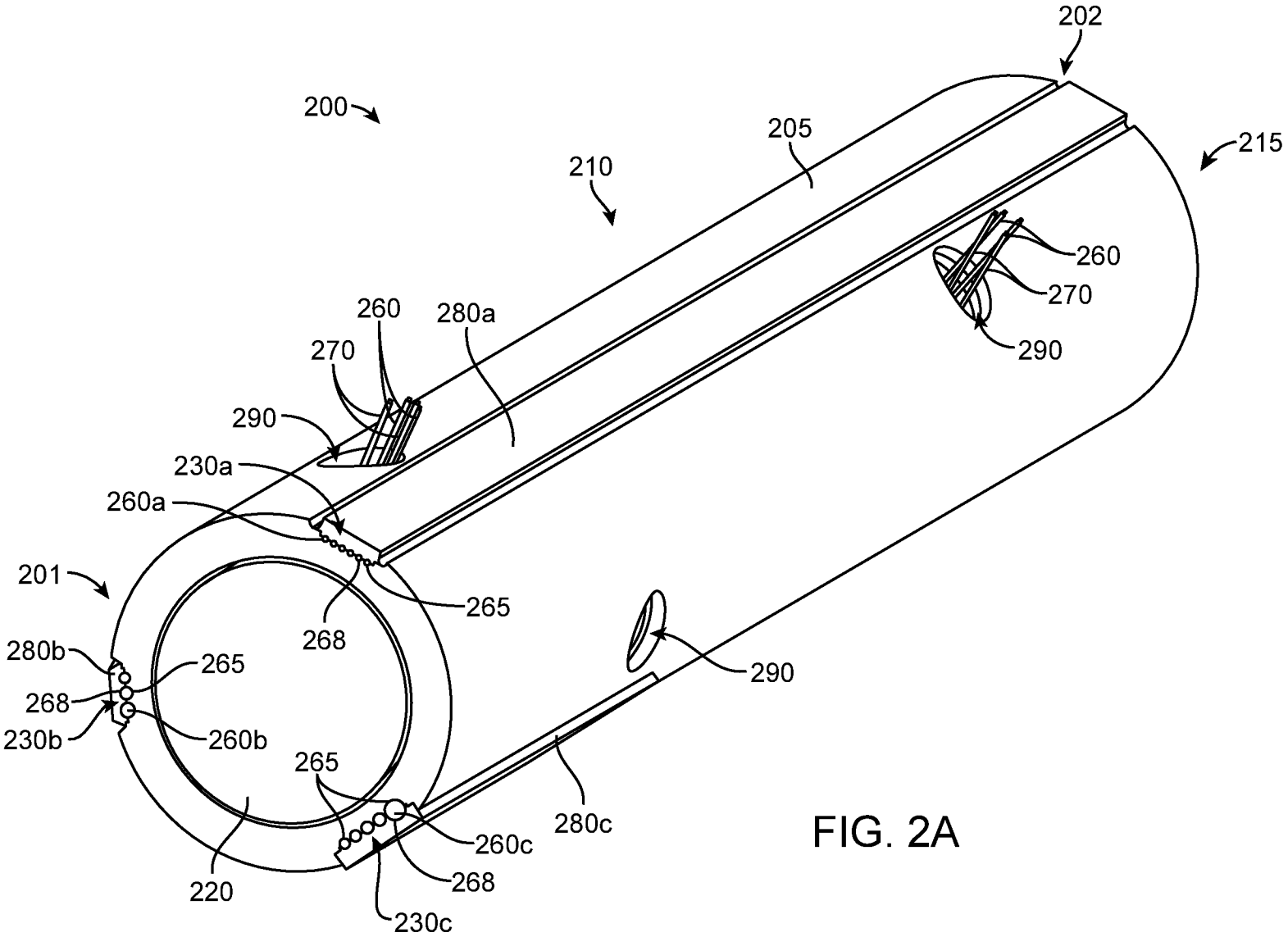
FIG. 2A illustrates a perspective view of a wire routing apparatus that includes a tubular body having a first end and a second end opposite the first end, according to an exemplary embodiment.

FIG. 2A illustrates a perspective view of a wire-routing apparatus 200 that includes a tubular body 210 having a first end 201 and a second end 202 opposite the first end 201. The tubular body 210 includes an outer circumferential surface 205 and a central bore 215 extending along a longitudinal axis of the tubular body 210. As depicted in FIG. 2A, the central bore 215 is sealed at the first end 201 of tubular body 210 by an end cap 220. While an end cap 220 is depicted in FIG. 2A, one or both ends of the tubular body 210 may be open without departing from the spirit and scope of the present disclosure.

Apparatus 200 includes a plurality of channels 230 (shown as 230*a*, 230*b*, 230*c*) parallel to the longitudinal axis of the tubular body 210 and disposed within the tubular body 210 between the central bore 215 and the outer circumferential surface 205. Each channel 230 is capable of receiving a wire 260. Channels 230 are formed by grooves 265, 268 that are disposed within tubular body 210 between the central bore 215 and the outer circumferential surface 205 of the tubular body 210. Each groove 265 extends parallel to the longitudinal axis of the tubular body 210. Tubular body 210 further includes covers 280 (shown as 280*a*, 280*b*, and 280*c*) that form a portion of outer circumferential surface 205. As depicted in FIG. 2A, each cover 280 also includes grooves 268 that form a portion of channels 230. While FIGS. 2*a-m* depict more than one set of channels 230 formed by covers 280*a-c*, wire routing apparatus 200 may include any number of channels 230 or any number of sets of channels 230 without departing from the spirit and scope of the present disclosure. For example, wire routing apparatus 200 may include just one or two sets of channels 230 or may include other sets of channels in addition to those shown. Wire routing apparatus 200 may also include just a single channel 230 disposed within tubular body 210 between the central bore 215 and the outer circumferential surface 205 of the tubular body 210.

During the manufacturing of tubular body 210, covers 280 enable the formation of channels 230 between the central bore 215 and outer circumferential surface 205 in tubular body 210 without the need for drilling deep holes through the longitudinal axis of tubular body 210. Specifically, during the manufacturing of tubular body 210, grooves 265, 268 may be formed in tubular body 210 followed by attachment of covers 280 to the remainder of tubular body 210 in order to form channels 230 for wire routing through tubular body 210. Therefore cover 280 forms a portion of the outer circumferential surface 205 of the tubular body 210 as well as an outer portion of channels 230. In at least some instances, cover 280 may be welded to the remainder of the tubular body 210. In some cases, following the welding of cover 280 to form a portion of the outer circumferential surface 205 of the tubular body 210, the tubular body 210, including cover 280, may be machined to form a consistent cylindrical outer circumferential surface 205 on tubular body 210. Covers 280 may also allow, in some instances, for easier installation of wires 260 within channels 230 during the manufacturing of apparatus 200, especially in the cases of longer or more elongated tubular bodies 210. In other cases, wires 260 may be installed in apparatus 200 following the manufacturing of apparatus 200 and tubular body 210.

Apparatus 200 having tubular body 210 may or may not include wires 260. In some cases, apparatus 200 includes wires 260 at least partially received in channels 230. In other cases, apparatus 200 includes channels 230 capable of receiving wires 260 but does not include wires 260 installed therein.

While FIG. 2A depicts covers 280 as forming at least a portion of channels 230, tubular body 210 may have channels 230 formed between the central bore 215 and outer circumferential surface 205 in the absence of covers 280, without departing from the spirit and scope of the present disclosure. For example, channels 230 that are substantially the same as those depicted in FIG. 2A may be drilled longitudinally through tubular body 210, and thus formed in the absence of cover 280. This may be the preferred apparatus in the case of shorter tubular bodies 210 for which drilling deep longitudinal holes to form channels 230 is not required. Covers 280 simply facilitate the forming of channels 230 during the manufacturing of tubular bodies 210

Although FIG. 2A depicts grooves 268 formed on covers 280 to form at least a portion of channels 230, as described in greater detail later in this disclosure, cover 280 may form a portion of channels 230 in the absence of grooves 268. For example, a substantially flat surface of cover 280 may form an outer portion of channels 230.

One or more downhole tools may be disposed within tubular body 210. For example, downhole tools 150, depicted in FIGS. 1A and 1B, may be disposed within tubular body 210. As described and shown later in this disclosure, one or more wires 260 received in channels 230 may be routed to a downhole tool 250 (not shown in FIG. 2A) disposed in the central bore 215 of tubular body 210. One or more wires 260 may also be routed to one or more downhole tools 250 coupled with tubular body 210. For example, one or more downhole tools 250 may be coupled with the first end 201 and/or second end 202 of tubular body 210. In some cases, tubular body 210 may be coupled with one or more additional tubular bodies, each of which may have one or more downhole tools 250 disposed therein.

As depicted in FIG. 2A, one or more wires 260 may enter or exit the first end 201 of tubular body 210. For example, one or more wires 260 may be communicatively coupled with a computer system 130 and or downhole computing device 128 at the surface 104, as depicted in FIG. 1A. Wires 260 may also be coupled with one or more devices at the surface 104 capable of transmitting electrical power through wires 260. Alternatively, one or more wires 260 may be communicatively coupled with a control or processing unit 186 at surface 195, as depicted in FIG. 1B. In such cases, wires 260 may also be coupled with one or more devices at the surface 195 capable of transmitting electrical power through wires 260.

While only one tubular body 210 is shown in FIG. 2A, wire routing apparatus 200 may include one or more tubular bodies. For example, the first end 201 and/or second end 202 of tubular body 210 may be coupled with one or more additional tubular bodies. According to at least one aspect of the present disclosure, the first end 201 and/or second end 202 of tubular body 210 may be coupled with one or more additional tubular bodies having channels for receiving wires that are substantially similar to those described with respect to tubular body 210. In such cases, wires 260 may be routed through one or more additional tubular bodies coupled with tubular body 210. For example, wires 260 entering or leaving the first end 201 of tubular body 210 may enter into a second tubular body coupled with the first end 201 of tubular body 210. The second tubular body may have channels, capable of receiving wires, disposed between the central bore and outer circumferential surface of the second tubular body. Routing of wires 260 through one or more additional tubular bodies coupled with tubular body 210 may provide for transmission of power, telemetry, and/or control signals between surface equipment and one or more downhole tools 250. In some cases, routing of wires 260 through one or more additional tubular bodies coupled with tubular body 210 may provide for transmission of telemetry and/or control signals between one or more downhole computer devices, such as downhole computing device 128 in FIG. 1A, and one or more downhole tools 250.

As depicted in FIG. 2A, tubular body 210 may further include sealable apertures 290, disposed on the circumferential surface 205 of tubular body 210. Sealable apertures 290 may provide communication between the central bore 215 and the circumferential surface 205 of tubular body 210. According to at least one aspect of the present disclosure, the sealable apertures 290 provides sufficient access to the central bore 215 of tubular body 210 such that one or more wires 260 can be connected to one or more tool wires 270. Tool wires 270 are coupled with one or more downhole tools 250. Thus, connection between wires 260 and tool wires 270 may provide communication and/or power between one or more downhole tools 250 and the surface or downhole computer. In at least some instances, tool wires 270 may be coupled with a downhole tool 250 disposed in the central bore 215 of tubular body 210. In other cases, tool wires 270 may be coupled with one or more downhole tools 250 that may be coupled with tubular body 210. For example, tool wires 270 may be coupled with a downhole tool 250 that is coupled with a first end 201 or second end 202 of tubular body 210. In other cases, tool wires 270 may be coupled with a downhole tool 250 disposed within a tubular body coupled with tubular body 210. Wires 260 and tool wires 270 may be connected by any method including, but not limited to, soldering, twisting, or through the use of connectors.

Figure 2B:
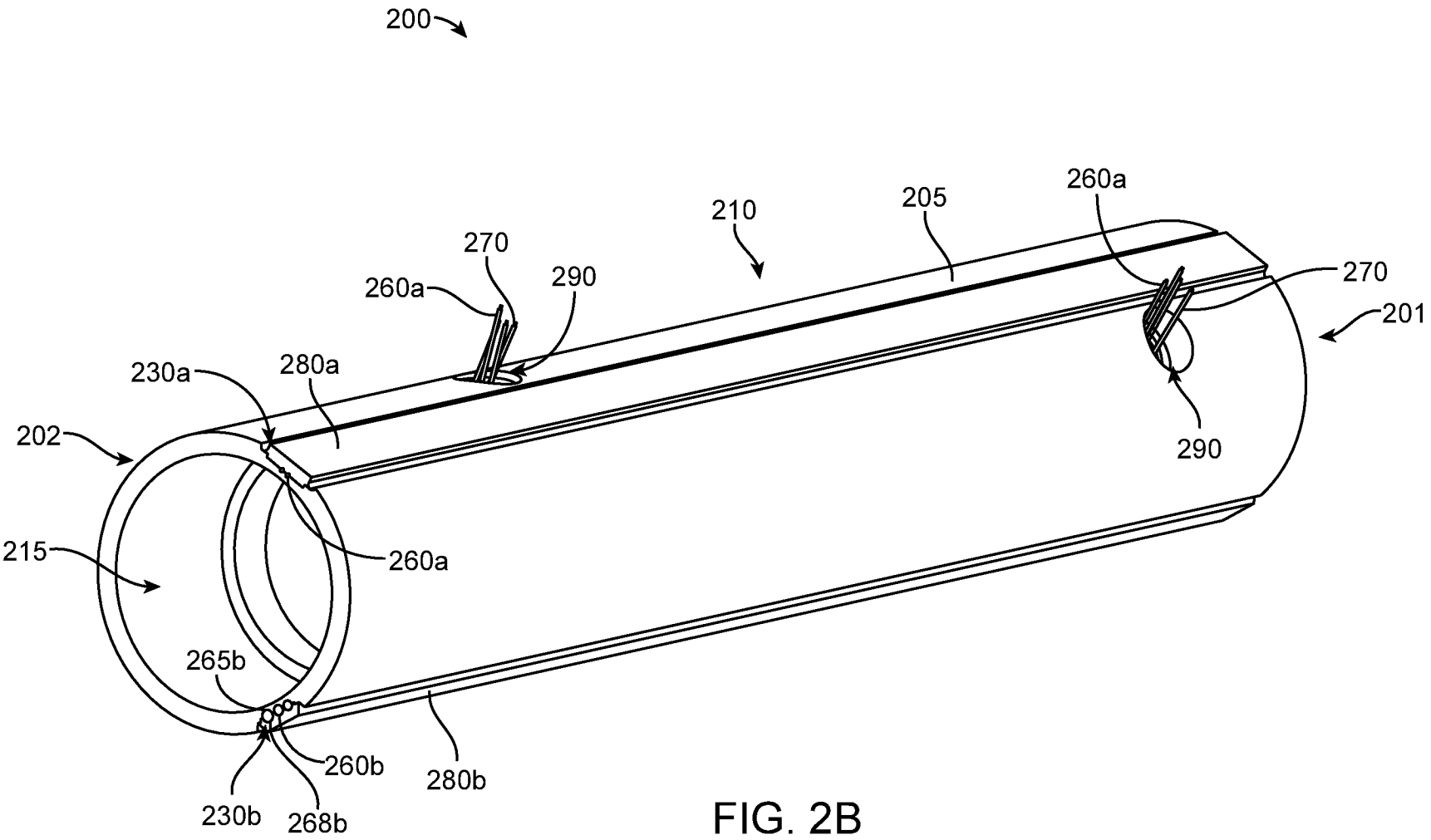
FIG. 2B illustrates a perspective view of a wire routing apparatus depicting the second end of a tubular body, according to an exemplary embodiment.

FIG. 2B illustrates a perspective view of a wire-routing apparatus 200 depicting the second end 202 of tubular body 210. As depicted in FIG. 2B, the second end 202 forms an opening to central bore 215 of tubular body 210. FIG. 2B further depicts channels 230*a* and 230*b* disposed between the central bore 215 and outer circumferential surface 205 of tubular body 210. As depicted in FIG. 2B, channels 230*a* and 230*b* extend parallel to the longitudinal axis of tubular body 210 from the first end 201 to the second end 202 of tubular body 210. Wires 260 received within channels 230*a* and 230*b* may exit or enter the second end 202 of tubular body 210. As depicted in FIG. 2B, only two of the six grooves 265*a*, 268*a* forming channels 230*a* extend the full length of tubular body 210. As shown and discussed in greater detail below, four of the six grooves forming channels 230*a* form a port providing for routing of four of wires 260*a* to the central bore 215 of tubular body 210. Routing of wires 260*a* to the central bore 215 of tubular body 210 may, for example, allow wires 260 to be coupled with tool wires 270 which are in turn coupled one or more downhole tools 250. The two wires 260*a* that extend the full length of tubular body 210 may transmit power, telemetry, and/or control signals to downhole tools 250 coupled with the second end 202 of tubular body 210. For example, wires 260*a* exiting the second end 202 of tubular body 210 may be routed into additional tubular bodies that may be coupled with the second end 202 of tubular body 210. In such cases, wires 260*a* may be coupled with one or more downhole tools 250 disposed within additional tubular bodies, coupled with the second end 202 of tubular body 210, or may be coupled with one or more downhole tools 250 coupled with the second end 202 of tubular body 210. As such, wire routing apparatus 200 provides for routing of wires 260 both through the entire length of tubular body 210 as well as into the central bore 215 of tubular body 210.

As depicted in FIG. 2B, channels 230*b* formed by grooves 265*b*, 268*b* extend the entire length of tubular body 210 thereby providing for the routing of wires 260*b* through the entire length of tubular body 210. In contrast, channels 230*c* and cover 280*c* do not extend to the second end 202 of tubular 210. Instead channels 230*c* form one or more ports providing for routing of wires 260*c* to the central bore 215 of tubular body 210.

Figure 2C:
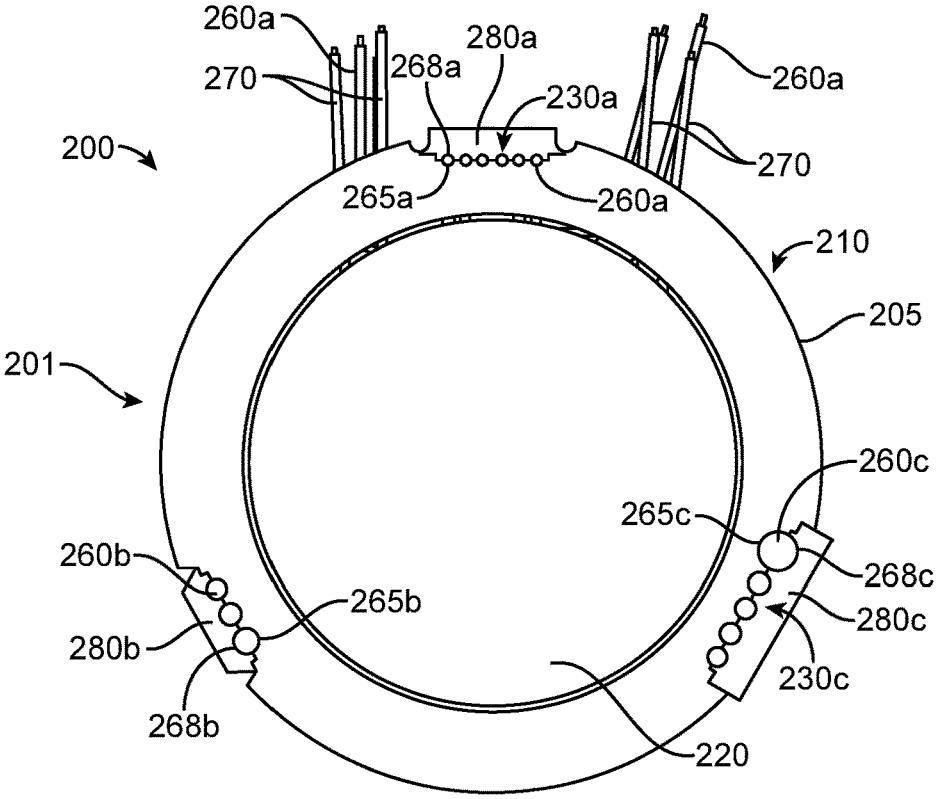
FIG. 2C illustrates an end view of a wire routing apparatus depicting the first end of a tubular body, according to an exemplary embodiment.

FIG. 2C illustrates an end view of wire routing apparatus 200 depicting the first end 201 of tubular body 210. As depicted in FIG. 2C, apparatus 200 includes a plurality of channels 230 parallel to the longitudinal axis of tubular body 210 and disposed within the tubular body 210 between the central bore 215 and the outer circumferential surface 205. Channels 230 are formed by grooves 265, 268 that are disposed within tubular body 210 between the central bore 215 and the outer circumferential surface 205 of the tubular body 210. Each groove 265, 268 extends parallel to the longitudinal axis of the tubular body 210. Tubular body 210 further includes covers 280 that form a portion of outer circumferential surface 205. As depicted in FIG. 2C, each cover 280 also includes grooves 268 that form a portion of channels 230. Each channel 230 has a wire 260 disposed therein. As depicted in FIG. 2C, the first end 201 of tubular body 210 includes an optional end cap 220 capable of sealing the first end 201 of tubular body 210.

Figure 2D:
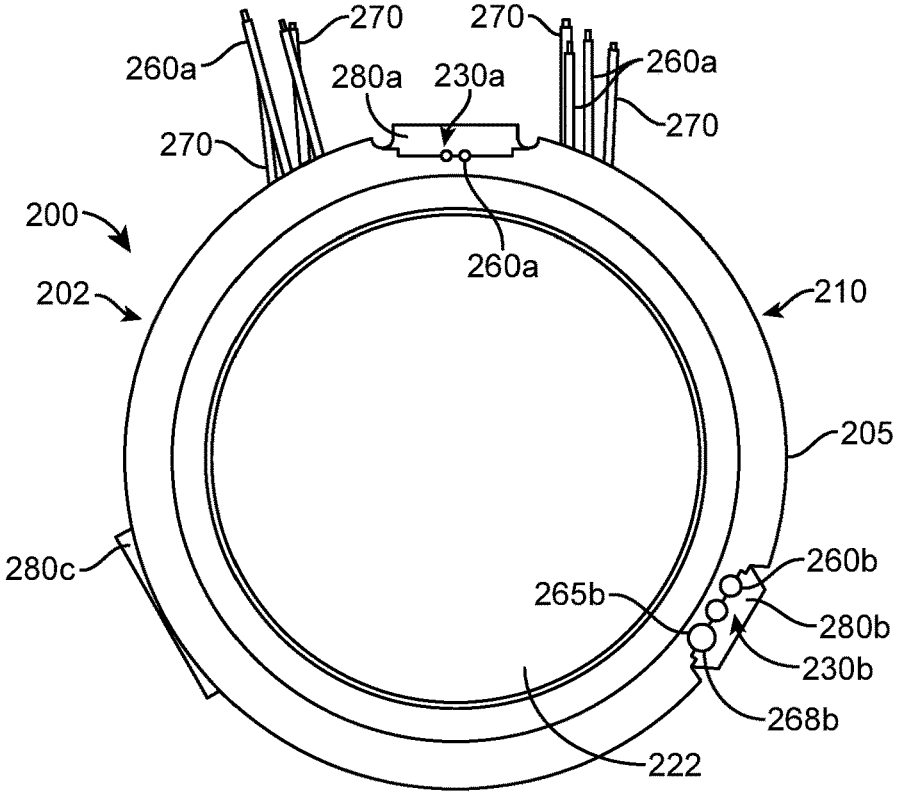
FIG. 2D illustrates an end view of a wire routing apparatus depicting the second end of a tubular body, according to an exemplary embodiment.

FIG. 2D illustrates an end view of wire routing apparatus 200 depicting the second end 202 of tubular body 210. As depicted in FIG. 2D, apparatus 200 includes a plurality of channels 230 parallel to the longitudinal axis of tubular body 210 and disposed within the tubular body 210 between the central bore 215 and the outer circumferential surface 205. Channels 230 are formed by grooves 265, 268 that are disposed within tubular body 210 between the central bore 215 and the outer circumferential surface 205 of the tubular body 210. Each groove 265, 268 extends parallel to the longitudinal axis of the tubular body 210. Tubular body 210 further includes covers 280 that form a portion of outer circumferential surface 205. As depicted in FIG. 2D, each cover 280 also includes grooves 268 that form a portion of channels 230. Each channel 230 has a wire 260 disposed therein. As depicted in FIG. 2D, the first end 201 of tubular body 210 includes an optional end cap 220 capable of sealing the first end 201 of tubular body 210.

Figure 2E:
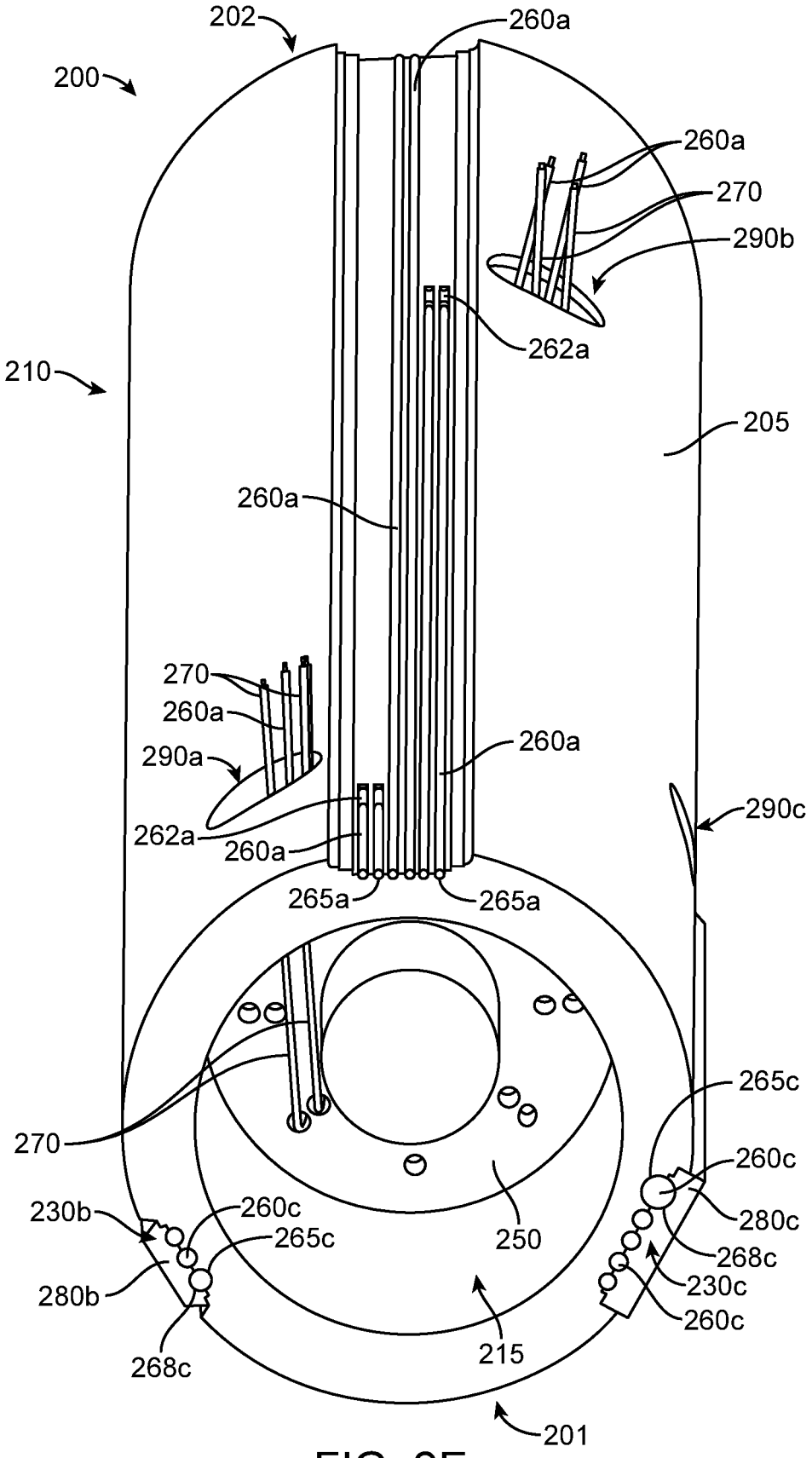
FIG. 2E illustrates a perspective view of the first end of a wire routing apparatus with cover removed to show wires disposed in grooves, according to an exemplary embodiment.

FIG. 2E illustrates a perspective view of the first end 201 of wire routing apparatus 200 with cover 280*a* removed to show wires 260*a* disposed in grooves 265*a*. As depicted in FIG. 2E, four of the six grooves 265*a* extend from the first end 201 along only a partial length of tubular body 210 before coupling with a port 262*a* that provides communication between a respective channel 265*a* and the central bore 215 of tubular body 210. Wires 260*a*, disposed in grooves 265*a*, extend from the first end 201 toward the second end 202 of tubular body 210. Four of the wires 260*a* enter the central bore 215 of tubular body 210 through ports 262*a*. The remaining two wires 260*a* extend the entire length of tubular body 210 and thus are capable of providing power, telemetry, and or control signals to downhole tools 250 coupled with the second end 202 of tubular body 210.

As depicted in FIG. 2E, a downhole tool 250 is disposed within the central bore 215 of tubular body 210. The downhole tool 250 may be, but is not limited to, a sliding sleeve assembly, a fluid or core sampling device, a setting tool, a logging tool, a wellbore isolation device, a fishing tool, a milling tool, a drilling tool, a reamer, a packer, a perforating tool, and a bridge plug. In some cases, the downhole tool may be any downhole tool that includes at least one selected from a motor, a clutch, a downhole sensor, a valve, and an actuation device.

As depicted in FIG. 2E, downhole tool 250 is coupled with tool wires 270 that may be coupled with the wires 260 that are routed into the central bore 215 through ports 262. Sealable apertures 290, disposed on the circumferential surface 205 of tubular body 210 adjacent to ports 262, may provide access to the central bore 215 sufficient to couple wires 260 with tool wires 270. Wires 260 and tool wires 270 are depicted in FIG. 2E prior to the wires being coupled with each other. Once wires 260 and tool wires 270 are coupled with each other, the wires may be pushed through sealable aperture 290 so that the wires can be stored in the central bore 215 of tubular body 210. According to at least one aspect of the present disclosure, the central bore 215 of tubular body 210 may include a wire storage space, suitable for storage of wires 260, 270, and accessible through sealable apertures 290. According to at least one aspect of the present disclosure, sealable aperture 290 may be sealed by a plug, for example, the plug depicted in FIG. 2M, while wires 260, 270 are disposed within central bore 215 of tubular body 210. As described above, coupling wires 260 to tool wires 270 may serve to provide electrical power, telemetry, and/or control signals between equipment at the surface or downhole computers and one or more downhole tools 250.

Figure 2F:
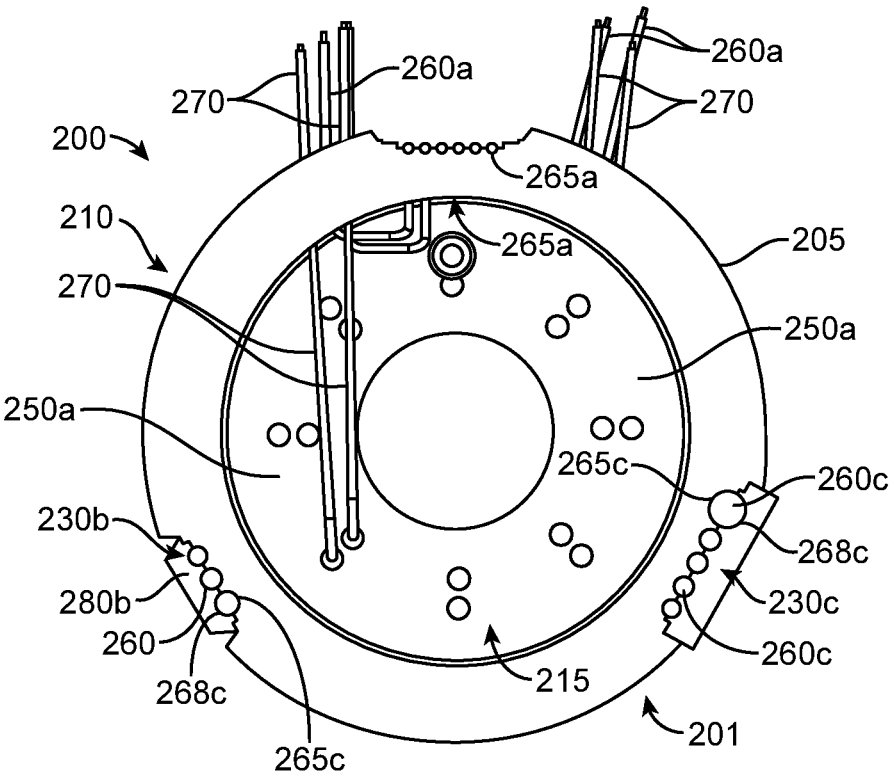
FIG. 2F illustrates an end view of the first end of a wire routing apparatus, according to an exemplary embodiment.

FIG. 2F illustrates an end view of the first end 201 of wire routing apparatus 200. As depicted in FIG. 2F, two of the wires 260*a* have entered the central bore 215 of tubular body 210 through port 262*a* and have been pulled through sealable aperture 290*a* so as to facilitate the coupling of wires 260*a* with tool wires 270. Tool wires 270 are coupled with downhole tool 250*b*. Wires 260*a* and tool wires 270 are depicted in FIG. 2F prior to the wires being coupled with each other. Once wires 260*a* and tool wires 270 are coupled with each other, the wires may be pushed through sealable aperture 290*a* so that the wires can be stored in the central bore 215 of tubular body 210.

Figure 2G:
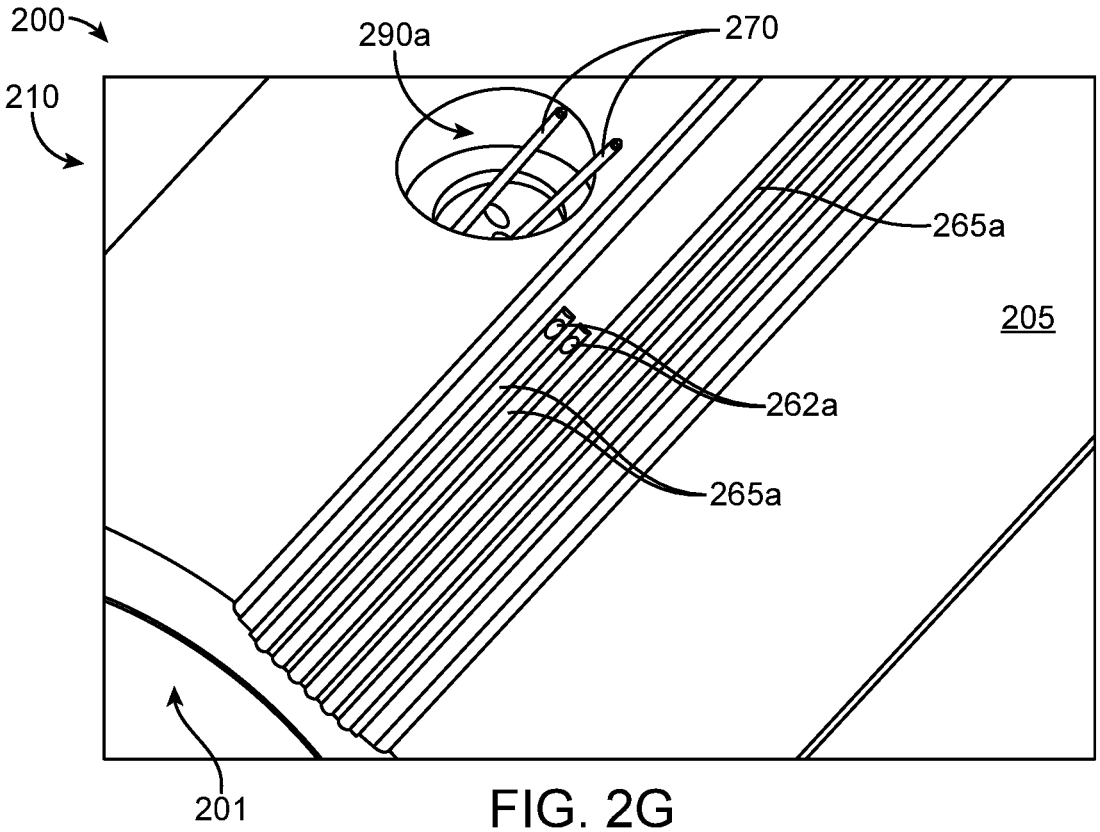
FIG. 2G illustrates a close-up top view of the first end of a wire routing apparatus without wires disposed in grooves, according to an exemplary embodiment.

FIG. 2G illustrates a close-up top view of the first end 201 of wire routing apparatus 200 without wires 260*a* disposed in grooves 265*a*. As depicted in FIG. 2G, two of the grooves 265*a* are coupled with ports 262*a* that provide communication between a respective channel 265*a* and the central bore 215 of tubular body 210. Wires that are disposed in grooves 265*a* may be routed into the central bore 215 of tubular body 210 through ports 262*a*. Sealable aperture 290*a*, disposed on the circumferential surface 205 of tubular body 210 adjacent to ports 262*a*, may provide access to the central bore 215 sufficient to couple wires with tool wires 270. Tool wires 270 are coupled with one or more downhole tools 250 (not shown in FIG. 2F). Tool wires 270 are depicted in FIG. 2G prior to the wires being coupled with each wires 260*a*. Once wires 260*a* and tool wires 270 are coupled with each other, the wires may be pushed through sealable aperture 290 so that the wires can be stored in the central bore 215 of tubular body 210.

Figure 2H:
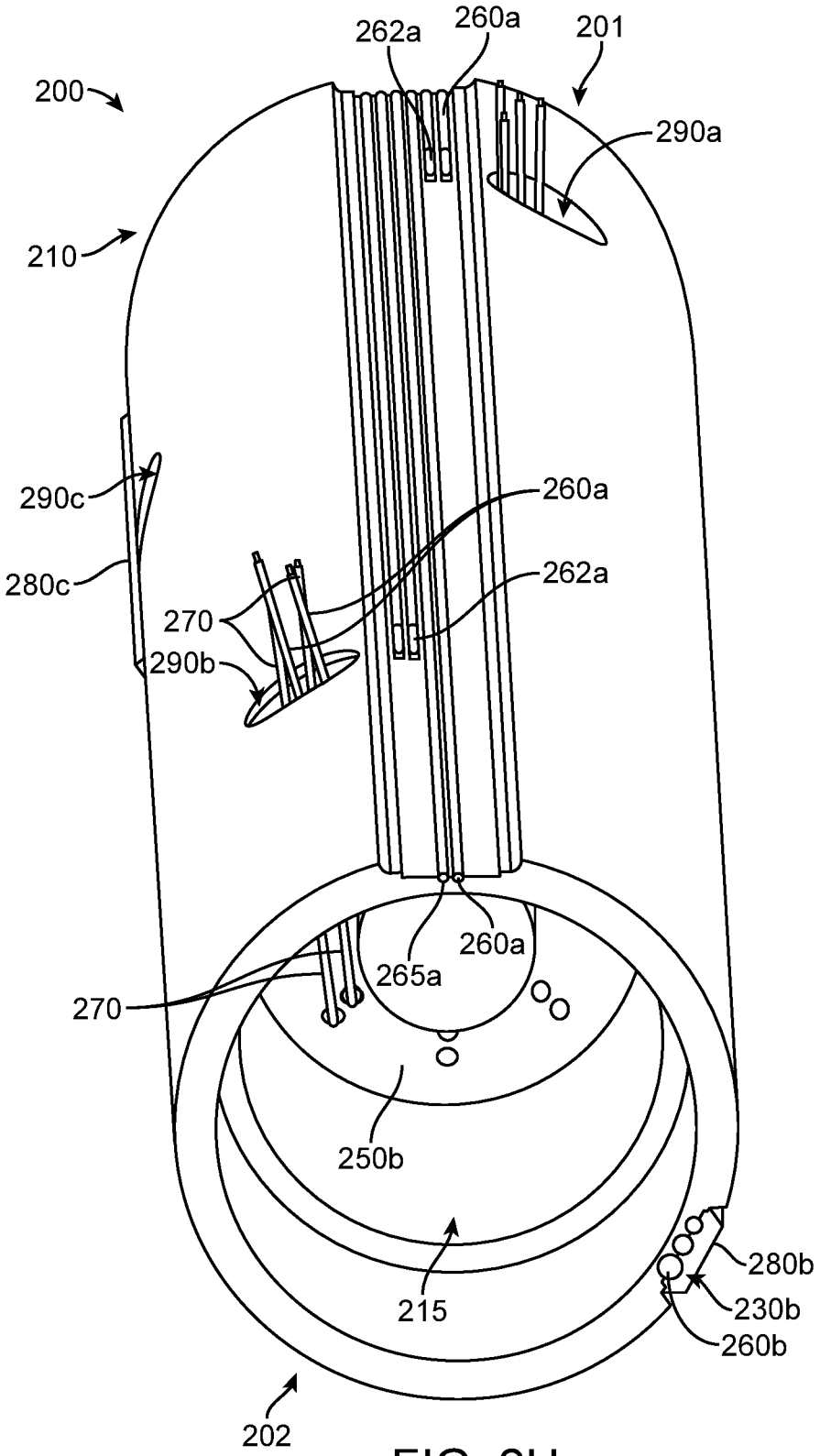
FIG. 2H illustrates a perspective view of the second end of a wire routing apparatus with cover removed to show wires disposed in the grooves, according to an exemplary embodiment.

FIG. 2H illustrates a perspective view of the second end 202 of wire routing apparatus 200 with cover 280*a* removed to show wires 260*a* disposed in grooves 265*a*. As depicted in FIG. 2H, two of the wires 260*a* are routed into the central bore 215 of tubular body 210 through ports 262*a* adjacent to sealable aperture 290*b* and downhole tool 250*b*. Tool wires 270, coupled with downhole tool 250*b*, may be coupled with wires 260*a* using the access to the central bore 215 of tubular body 210 provided by sealable aperture 290*b*.

The remaining two wires 260*a* extend the entire length of tubular body 210 and thus are capable of providing power, telemetry, and or control signals to downhole tools 250 coupled with the second end 202 of tubular body 210.

Figure 2I:
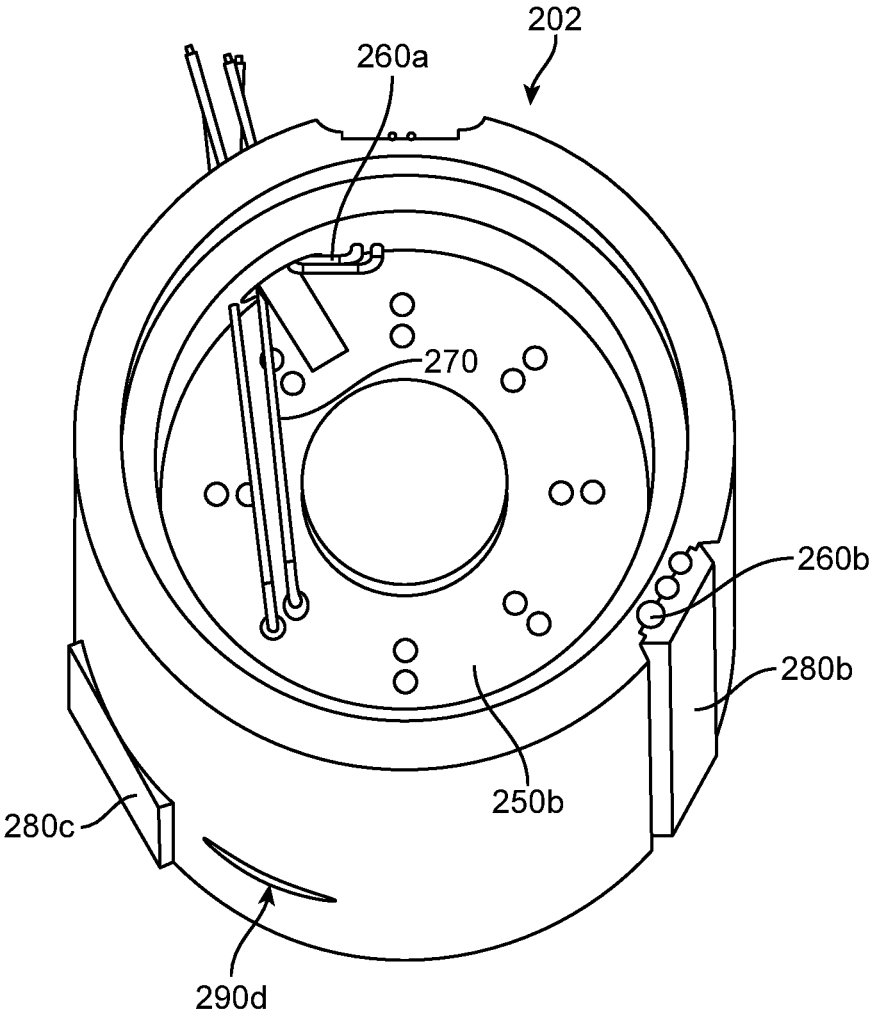
FIG. 2I illustrates a perspective view of the second end of a wire routing apparatus depicting wires entering the central bore of a tubular body through ports adjacent to the sealable aperture, according to an exemplary embodiment.

FIG. 2I illustrates a perspective view of the second end 202 of wire routing apparatus 200 depicting wires 260*a* entering the central bore 215 of tubular body 210 through ports 262*a* adjacent to sealable aperture 290*b*. As depicted in FIG. I, wires 260*a* are further routed through sealable aperture 290*b* in order to facilitate coupling with tool wires 270 from outside the tubular body 210. Wires 260*a* and tool wires 270 are depicted in FIG. 2I prior to the wires being coupled with each other. Once wires 260*a* and tool wires 270 are coupled with each other, the wires may be pushed through sealable aperture 290*b* so that the wires can be stored in the central bore 215 of tubular body 210.

Figure 2J:
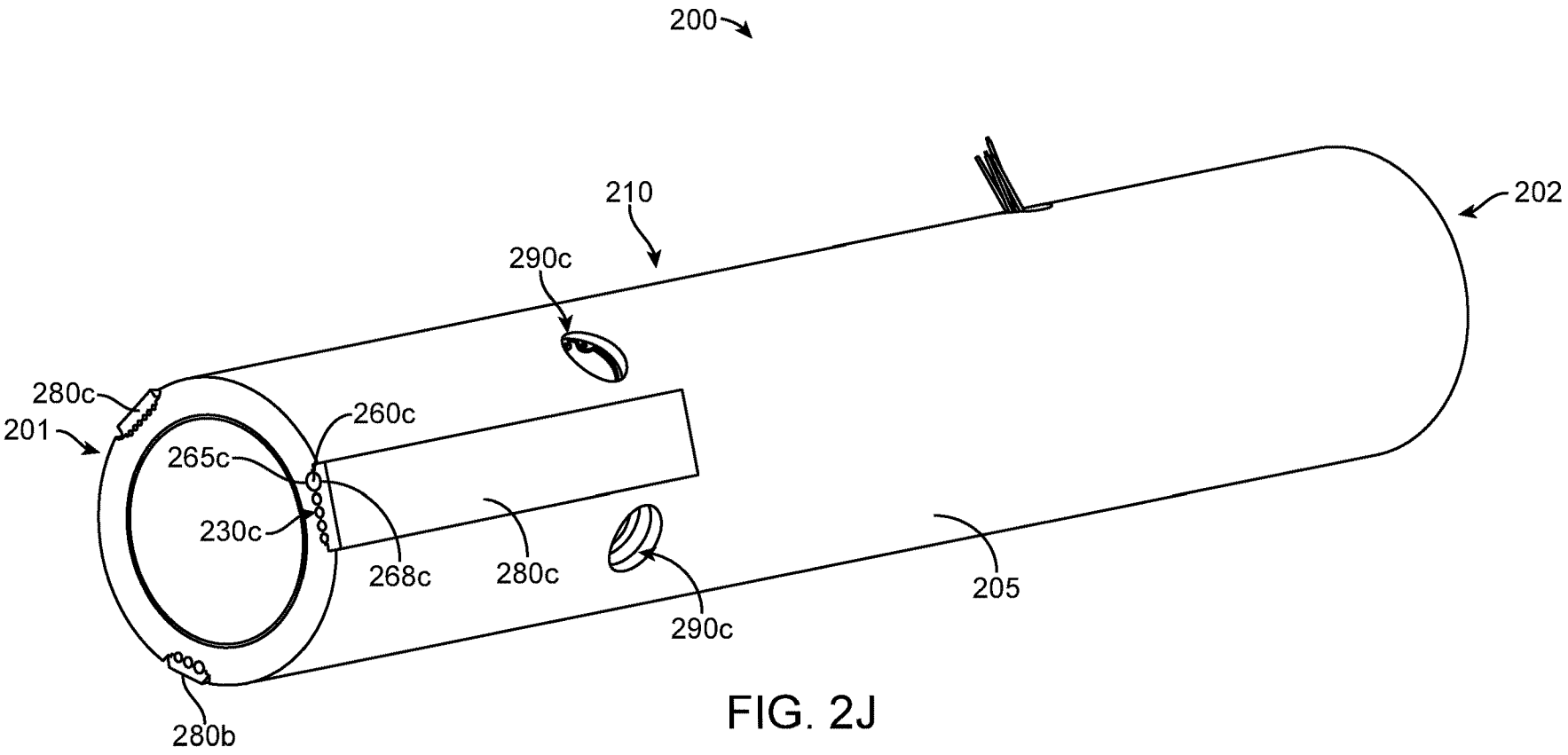
FIG. 2J illustrates a perspective view of a wire routing apparatus having a cover that forms a portion of the outer circumferential surface along a part of the length of a tubular body, according to an exemplary embodiment.

FIG. 2J illustrates a perspective view of wire routing apparatus 200 having a cover 280*c* that forms a portion of outer circumferential surface 205 along a part of the length of tubular body 210. In contrast to covers 280*a* and 280*b* which extend along the full length of tubular body 210, cover 280*c* only extends along a portion of the full length of tubular body 210. Covers such as cover 280*c* may be used when all of the wires received in channels 230 are routed into the central bore 215 of tubular body 210. As depicted in FIG. 2J, sealable apertures 290*c*, 290*d* are disposed on the outer circumferential surface 205 adjacent to the terminal portion of cover 280*c*. According to at least one aspect of the present disclosure, one or more sealable apertures 290 may be disposed on the outer circumferential surface 205 adjacent to both sides of a cover in order to provide sufficient access to the central bore 215 to facilitate coupling of wires 260*c* to tool wires 270.

Figure 2L:
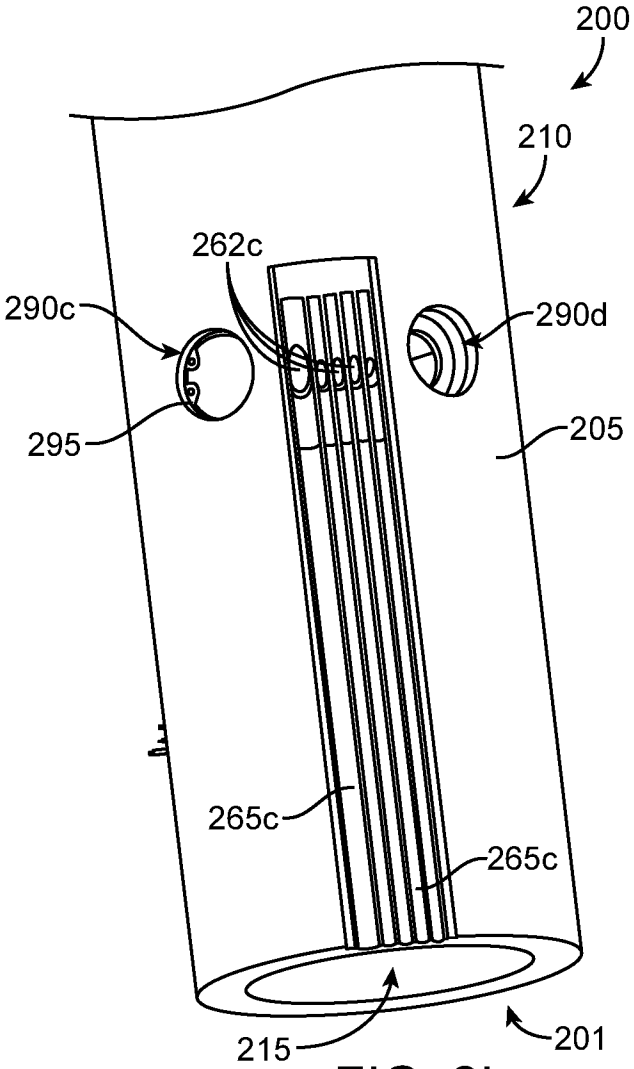
FIG. 2L illustrates a close-up perspective view of the first end of a tubular body having grooves that extend along a portion of the length of the tubular body, according to an exemplary embodiment.
Figure 2K:
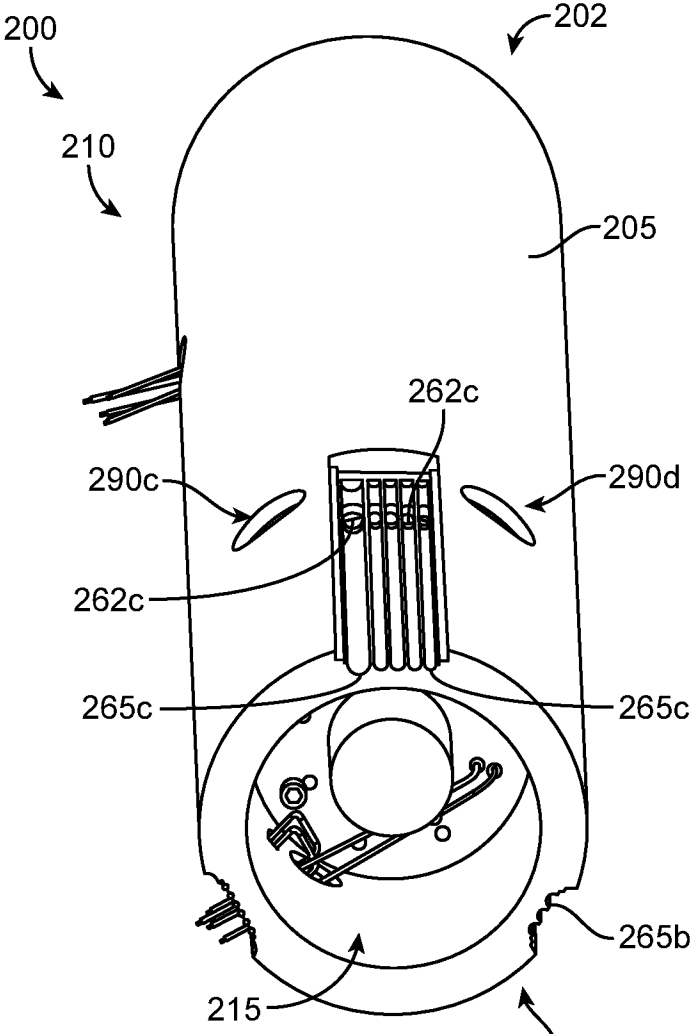
FIG. 2K illustrates a perspective view of a wire routing apparatus having grooves that extend along a portion of the length of the tubular body, with the cover and wires removed, according to an exemplary embodiment.
Figure 2M:
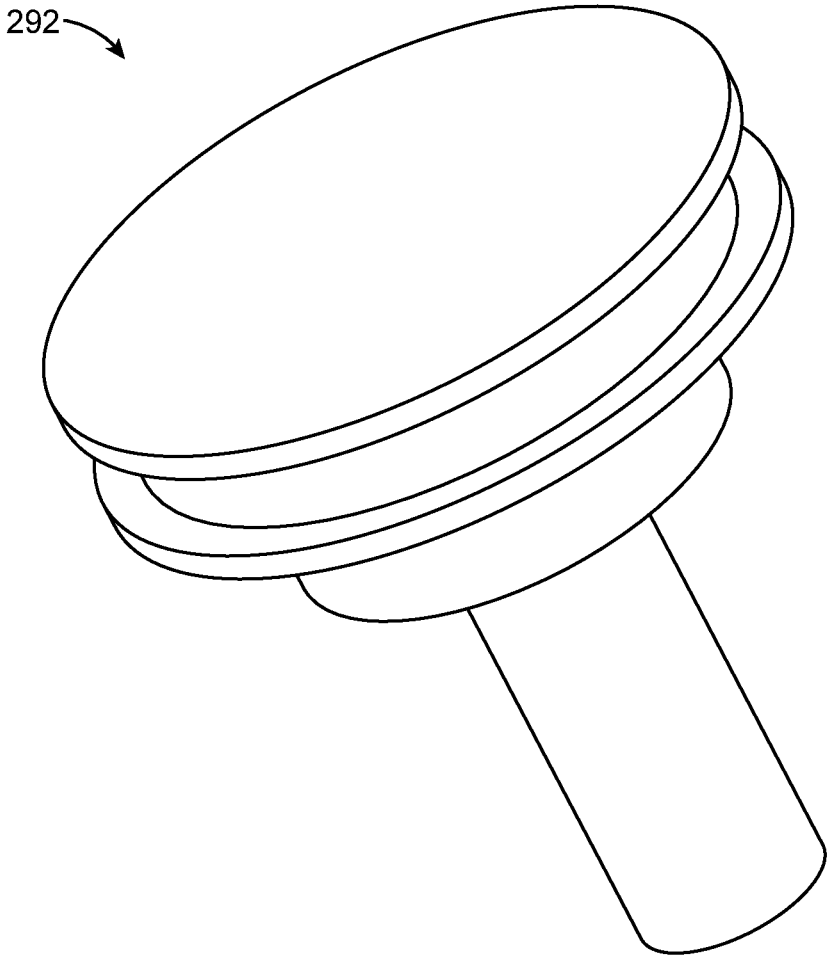
FIG. 2M illustrates a perspective view of a plug that may be used to seal a sealable aperture, according to an exemplary embodiment.

FIG. 2K illustrates a perspective view of wire routing apparatus 200 having grooves 265*c* that extend along a portion of the length of tubular body 210, with the cover 280*c* and wires 260*c* removed. As depicted in FIG. 2K, grooves 265*c* extend from the first end 201 toward the second end 202 of tubular body 210 before coupling with ports 262*c* that provide communication between a respective channel 265*c* and the central bore 215 of tubular body 210. Wires 260*c* may be received in grooves 265*a* and routed into the central bore 215 of tubular body 210 through ports 262*c* and coupled with one or more downhole tools 250 disposed in the central bore 215 of tubular body 210.

FIG. 2L illustrates a close-up perspective view of the first end 201 of tubular body 210 having grooves 265*c* that extend along a portion of the length of tubular body 210. As depicted in FIG. 2L, grooves 265*c* are coupled with ports 262*c* that provide communication between a respective channel 265*c* and the central bore 215 of tubular body 210. Sealable apertures 290*c*, 290*d* are disposed on the outer circumferential surface 205 adjacent to ports 262*c*. Sealable apertures 290*c*, 290*d* may provide sufficient access to the central bore 215 to facilitate coupling of wires 260*c* to tool wires that may be coupled with one or more downhole tools disposed in the central bore 215 of tubular body 210. Sealable apertures 290*c*, 290*d* may be sealed using a plug, for example, plug 292 depicted in FIG. 2M. As depicted in FIG. 2L, sealable aperture 290*c* includes a retaining ring 295 capable of retaining plug 292.

Figure 2N:
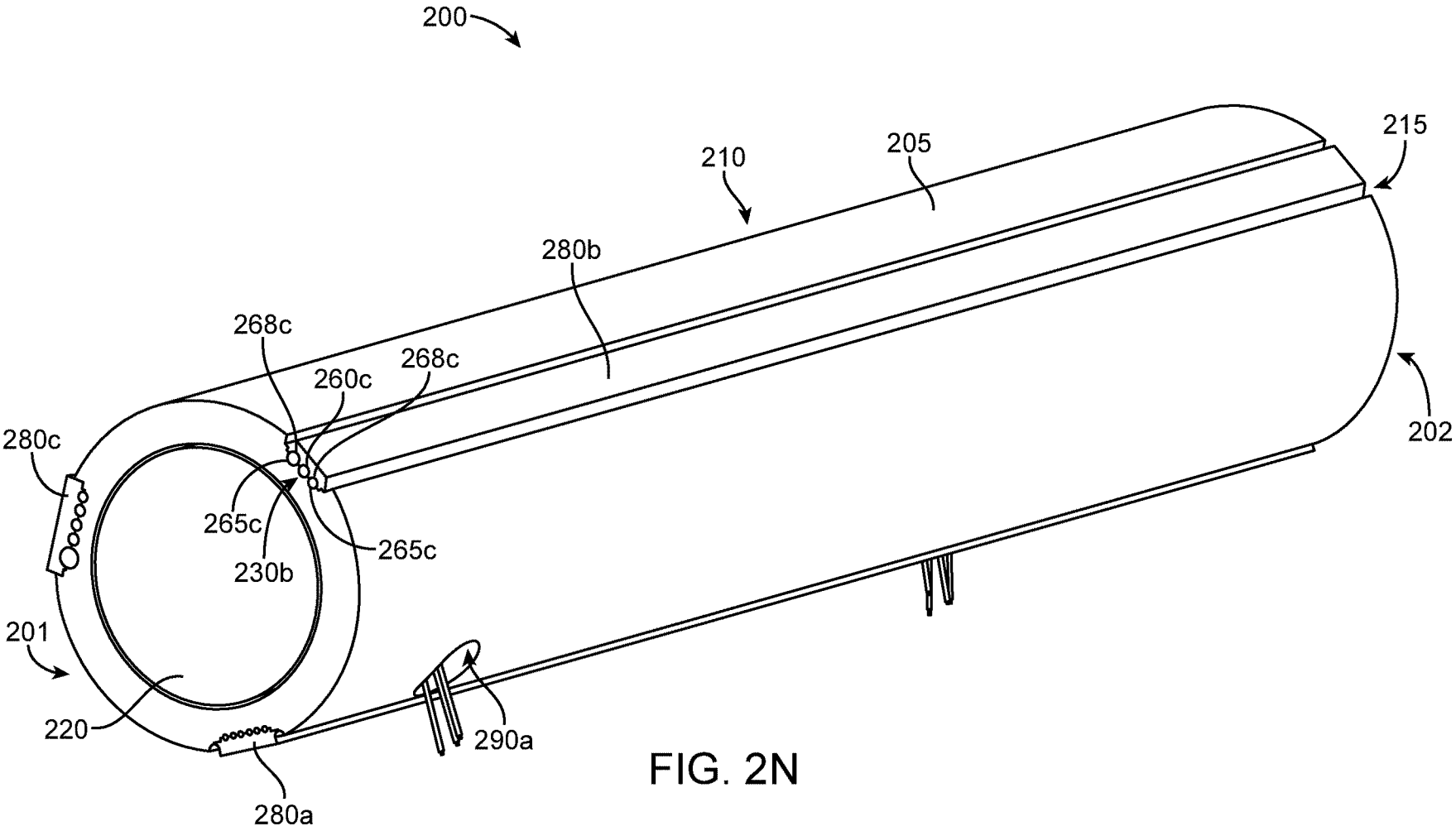
FIG. 2N illustrates a perspective view of a wire routing apparatus having a cover that extends the full length of a tubular body, according to an exemplary embodiment.

FIG. 2N illustrates a perspective view of wire routing apparatus 200 having a cover 280*b* that extends the full length of tubular body 210. Cover 280*b* forms a portion of outer circumferential surface 205 of tubular body 210 as well as a portion of channels 230*b*. Channels 230 extend parallel to the longitudinal axis of tubular body 210 and are disposed within the tubular body 210 between the central bore 215 and the outer circumferential surface 205. Channels 230*c* are formed by grooves 265*c* and 268*c* that extend parallel to the longitudinal axis of the tubular body 210. Grooves 268*c* are formed on cover 280*c*. Grooves 265*c*, 268*c* are disposed within tubular body 210 between the central bore 215 and the outer circumferential surface 205. As depicted in FIG. 2N, each channel 230*c* has a wire 260*c* disposed therein. Tubular body 210 is depicted in FIG. 2N as including an optional end cap 220 capable of sealing the first end 201 of tubular body 210.

Covers extending the full length of tubular body 210 may be used when at least one channel 230, formed at least in part by the respective cover, extends the full length of tubular body 210. Channels that extend the full length of the tubular body 210 may be used to receive wires that are routed through the entire length of tubular body 210 in order to transmit power, telemetry, and/or control signals to one or more downhole tools coupled with either the first end 201 or second end 202 of tubular body. For example, wires routed through the entire length of tubular body 210 may be used to transmit power, telemetry, and/or control signals to one or more downhole tools disposed in or coupled with a second tubular body coupled with the first end 201 or second end 202 of tubular body 210. In other cases, wires routed through the entire length of tubular body 210 may be used to transmit power, telemetry, and/or control signals to one or more downhole tools attached to the first end 201 or second end 202 of tubular body 210.

Figure 2O:
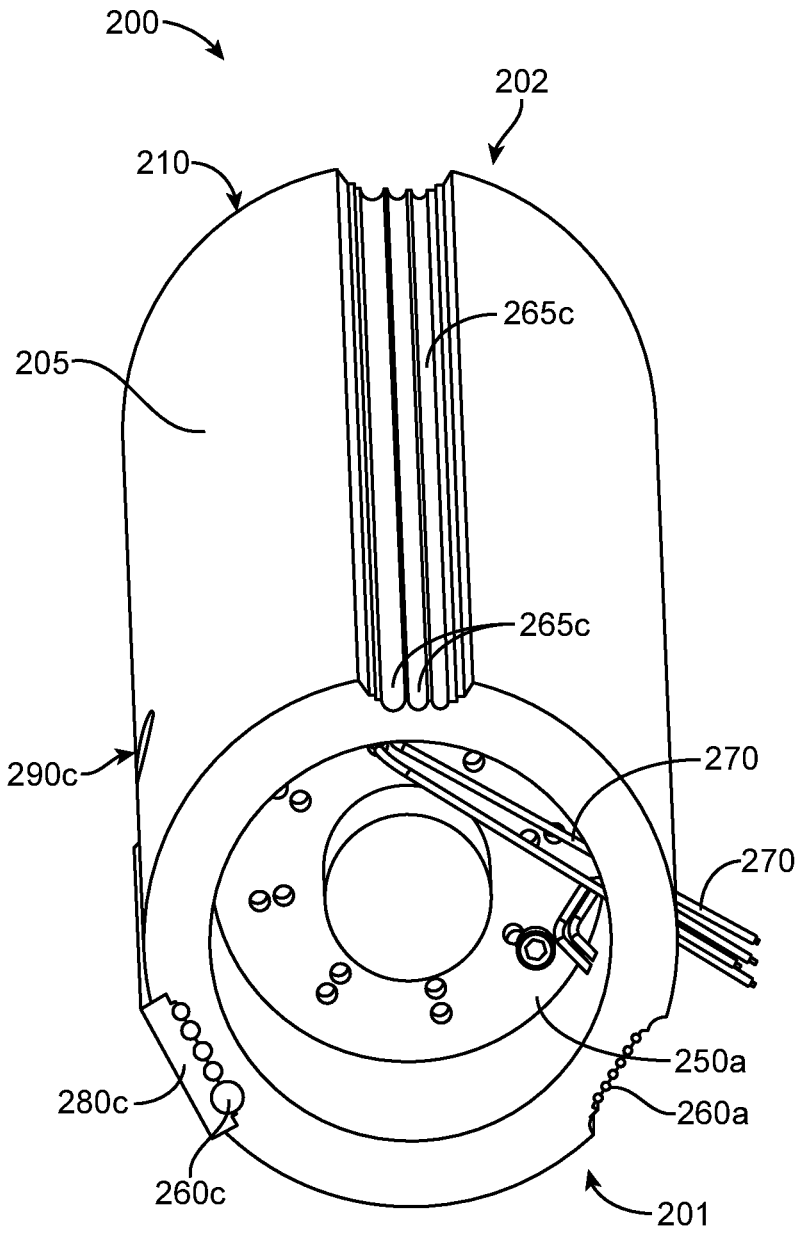
FIG. 2O illustrates a perspective view of a wire routing apparatus with grooves that extend the full length of a tubular body, according to an exemplary embodiment.

FIG. 2O illustrates a perspective view of wire routing apparatus 200 with grooves 265*c* that extend the full length of tubular body 210. As depicted in FIG. 2O, cover 280*b* and wires 260*c* have been removed showing grooves 265*c* extending from the first end 201 to the second end 202 of tubular body 210. Grooves 265*c* are capable of receiving wires which may be routed through the entire length of tubular body 210 in order to transmit power, telemetry, and/or control signals between one or more downhole tools coupled with either the first end 201 or second end 202 of tubular body and equipment at the surface or a downhole computer.

Figure 2P:
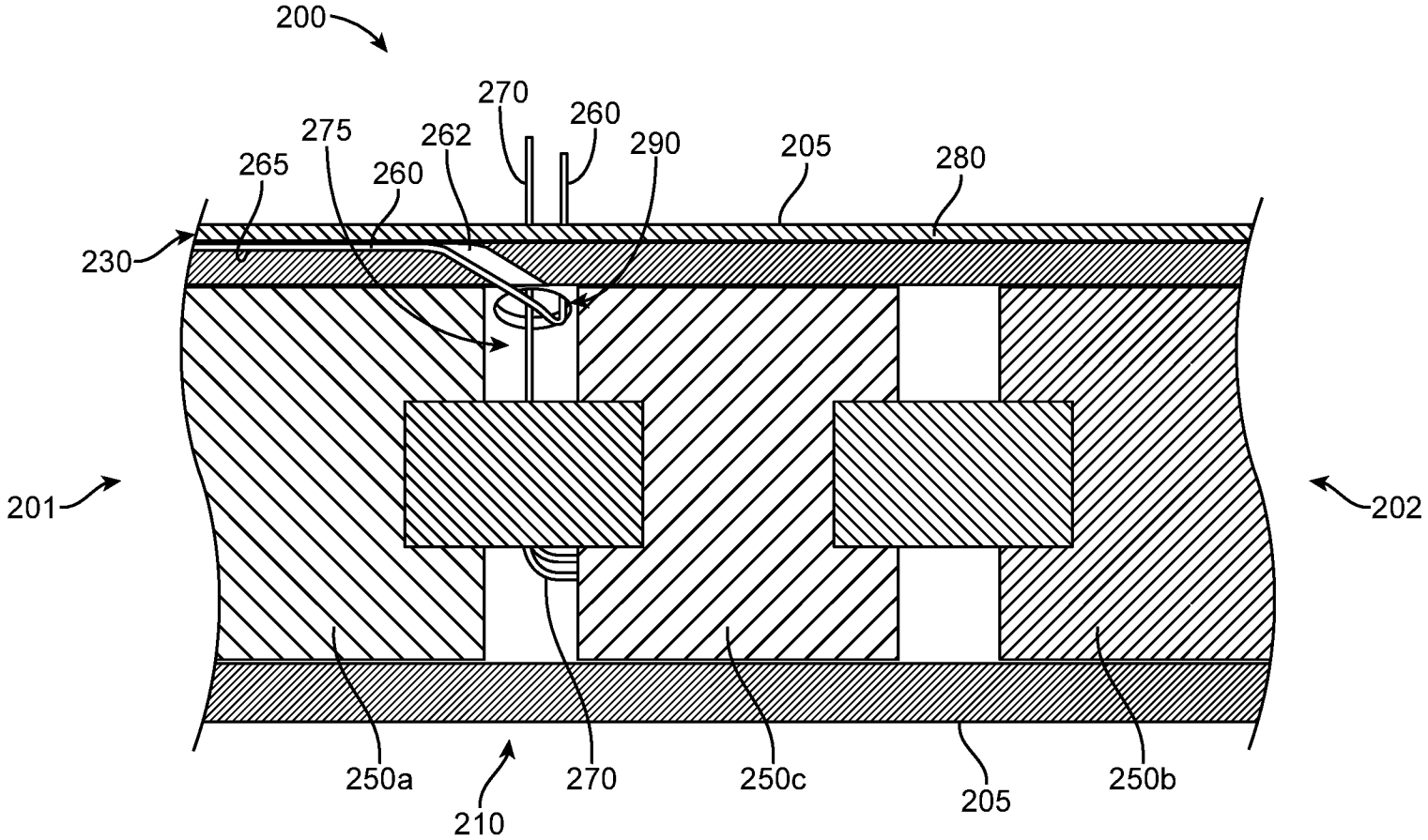
FIG. 2P illustrates a close-up cross-sectional view of a wire routing apparatus having a tubular body that includes ports between the central bore and channels, according to an exemplary embodiment.

FIG. 2P illustrates a close-up cross-sectional view of wire routing apparatus 200 having tubular body 210. As depicted in FIG. 2P, tubular body 210 includes ports 262 between the central bore 215 and channels 230. Ports 262 provide a path for the routing of one or more wires 260, received in one or more channels 230, into the central bore 215 so that they may be coupled with one or more downhole tools 250 disposed in the central bore 215 of tubular body 210. As depicted in FIG. 2P, wire 260 has been routed into central bore 215 of tubular body 210 through port 262 adjacent to sealable aperture 290. As further depicted in FIG. 2P, wire 260 is further routed through sealable aperture 290 in order to facilitate coupling with tool wires 270 from outside the tubular body 210. Wire 260 and tool wires 270 are depicted in FIG. 2P prior to the wires being coupled with each other. Once wire 260 and tool wires 270 are coupled with each other, the wires may be pushed through sealable aperture 290 so that the wires can be stored in the central bore 215 of tubular body 210. According to at least one aspect of the present disclosure, the tubular body 210 includes a wire storage chamber 275 in the central bore 215. The wire storage chamber 275 may be used to store wires 260 and tool wires 270.

As depicted in FIG. 2P, port 262 is a slanted or sloped port that provides communication between the central bore 215 of tubular body 210 and one or more channels 230. Port 262 may be any shape that provides a path for routing one or more wires 260, received in one or more channels 230, into the central bore 215 so that they may be coupled with one or more downhole tools 250 disposed in the central bore 215 of tubular body 210. Port 262 may be continuous with groove 265. According to at least one aspect of the present disclosure, port 262 may be formed at least in part by groove 265. While only one port 262 is visible in the cross-sectional view depicted in FIG. 2P, tubular body 210 may include multiples ports, for example a port corresponding to each of the channels 230 or grooves 265 included in tubular body 210. In other cases, a single port 262 may provide a path for routing a plurality of wires 260, each received in one or more channels 230, into the central bore 215 of tubular body 210.

Figure 3A:
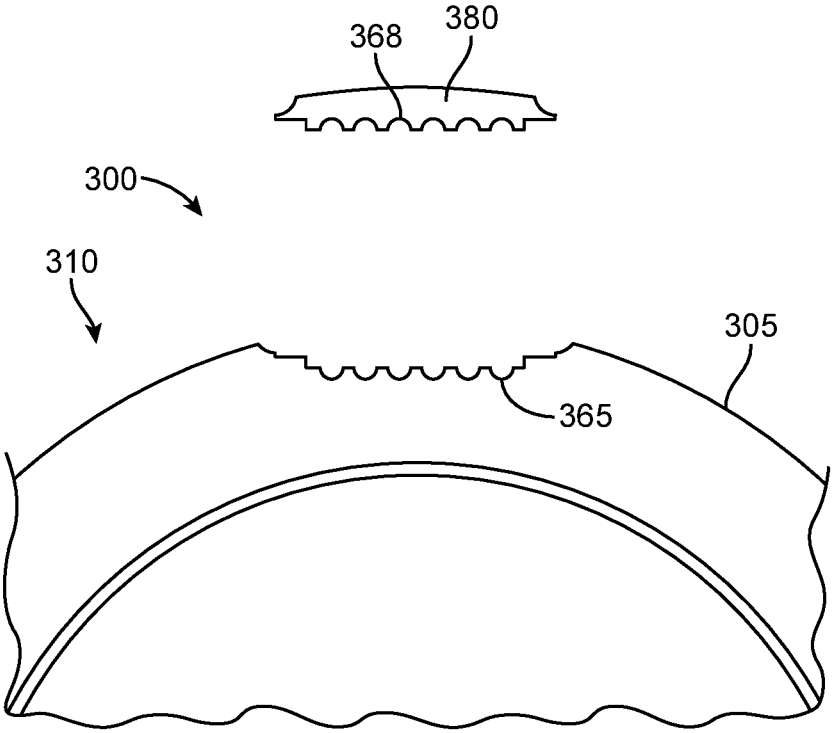
FIG. 3A illustrates a close-up end view of a wire routing apparatus having a plurality of channels formed at least in part by grooves formed on a cover, according to an exemplary embodiment.
Figure 3B:
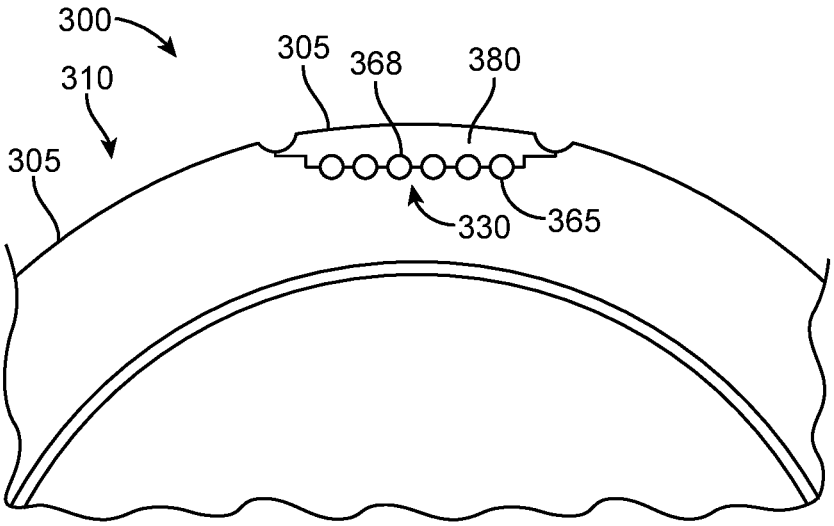
FIG. 3B illustrates a close-up end view of a wire routing apparatus having a cover that forms a portion of the outer circumferential surface of the tubular body, according to an exemplary embodiment.
Figure 3C:
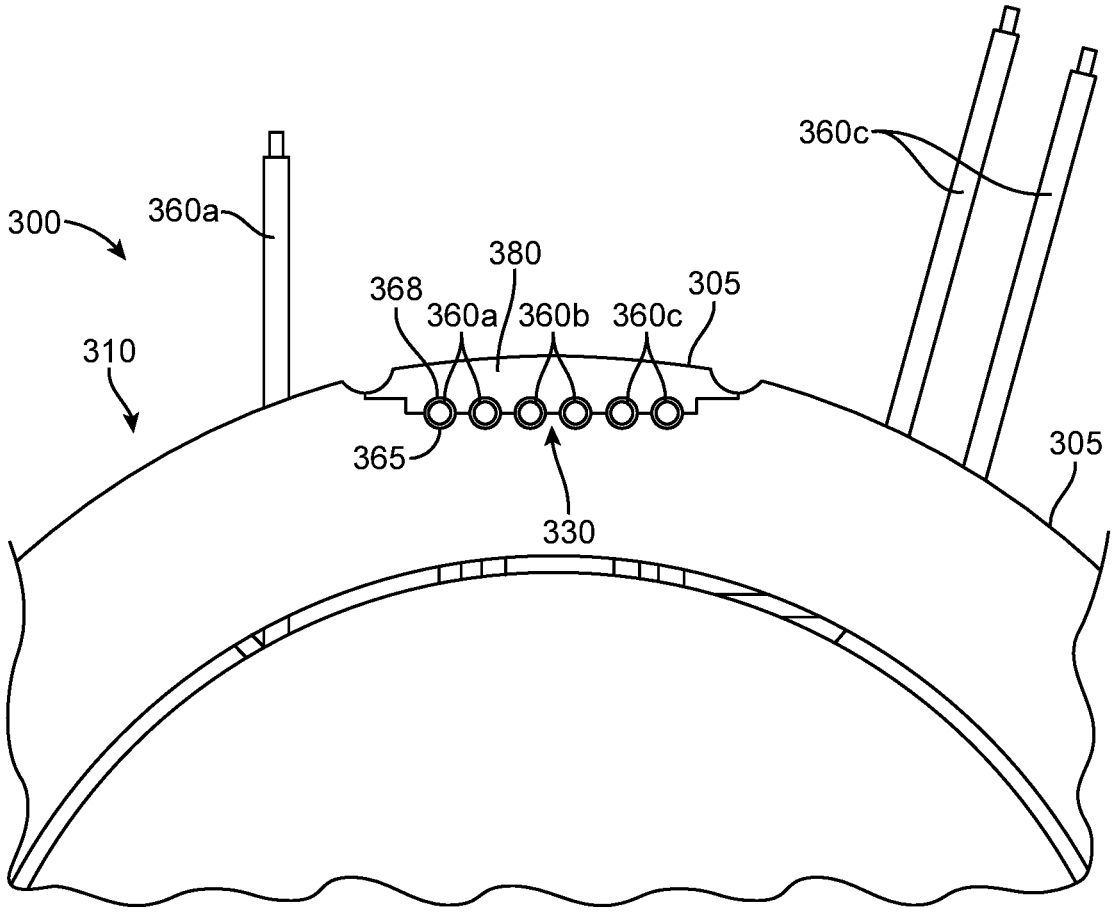
FIG. 3C illustrates the close-up end view of a wire routing apparatus having wires received in each of the channels formed by the grooves, according to an exemplary embodiment.

FIGS. 3A-C illustrate close-up end views of wire routing apparatus 300 having a plurality of channels 330 formed at least in part by grooves 368 formed on cover 380. FIG. 3A depicts cover 380 spaced apart from the remainder of tubular body 310 and prior to attachment of cover 380 to form a portion of outer circumferential surface 305 of tubular body 310. Cover 380 includes grooves 368 corresponding to grooves 365 formed on the remainder of tubular body 310.

FIG. 3B depicts cover 380 forming a portion of outer circumferential surface 305 of tubular body 310. Channels 330 are formed by grooves 365, 368 that are disposed within tubular body 310 between the central bore 315 and the outer circumferential surface 305 of the tubular body 310. Each groove 365 extends parallel to the longitudinal axis of the tubular body 310.

Each channel 330 is capable of receiving a wire 360. As depicted in FIG. 3C, wires 360*a-c* are received in each of the channels 330 formed by grooves 365, 368. According to at least one aspect of the present disclosure, hydraulic fluid may be pumped through one or more channels 330 having a wire 360 received therein. For example, hydraulic fluid may be pumped in the annular space between wires 360 and the walls of channels 330 formed by grooves 365, 368. The hydraulic fluid may serve to equalize pressure within the channels 330. In at least some cases, equalizing the pressure within the channels by flowing hydraulic fluid through the channels 330 may increase the downhole survivability and/or downhole performance of wires 360. The use of channels 330, having wires 360 received therein, as a conduit for hydraulic fluid eliminates the need for including a separate hydraulic flow path in tubular body 310. Cover 380 is attached to the rest of tubular body 310 such that channels 330 are sufficiently sealed to allow hydraulic fluid to be pumped through one or more channels 330 without leaking from tubular body 310. In at least some cases, cover 380 includes grooves along the edge of the cover in order to facilitate forming a sufficient seal during the welding of cover 380 to the rest of tubular body 310.

Figure 4:
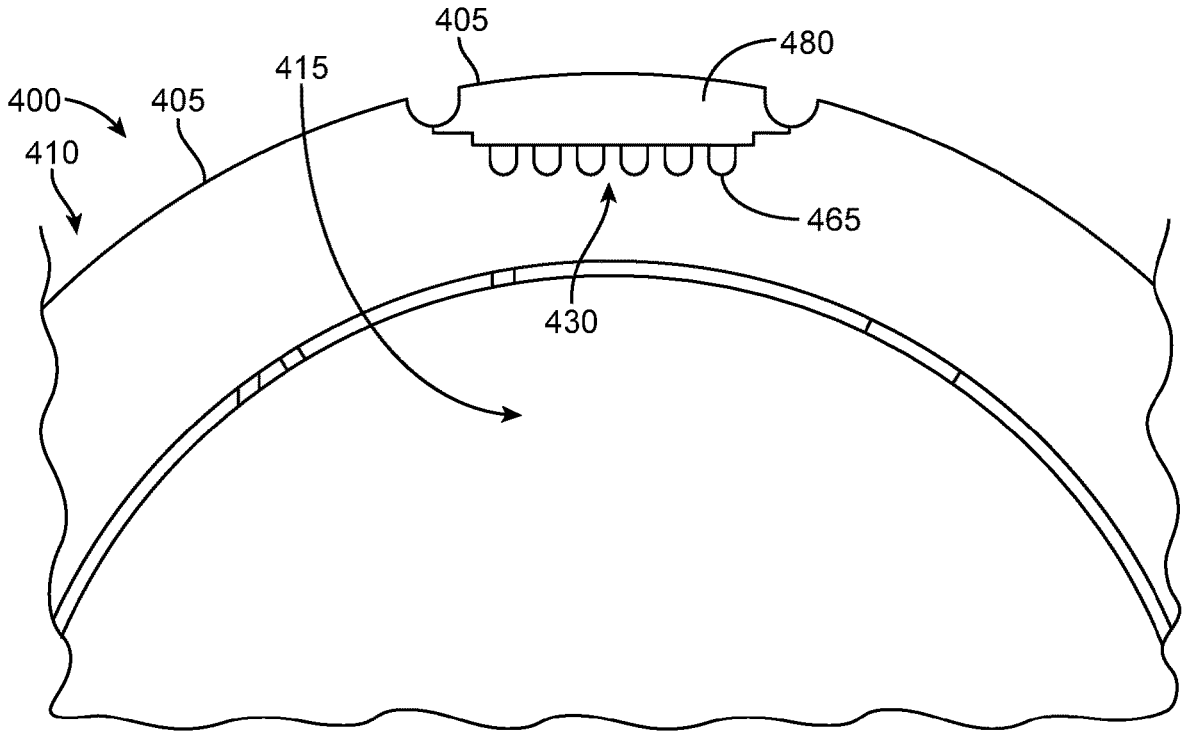
FIG. 4 illustrates a close-up end view of a wire routing apparatus that includes a plurality of channels formed at least in part by a cover, in the absence of grooves formed on cover, according to an exemplary embodiment.

FIG. 4 illustrates a close-up end view of a wire routing apparatus 400 that includes a plurality of channels 430 formed at least in part by a cover 480, in the absence of grooves formed on cover 480. As depicted in FIG. 4, cover 480 may form a portion of channels 430 without having one or more grooves formed on the cover 480. In such cases, grooves 465 disposed within the tubular body 410 between the central bore 415 and outer circumferential surface 405 are sufficient to receive one or more wires (not shown).

FIG. 5 illustrates a perspective view of a wire routing apparatus 500 that includes a tubular body 510 having an aperture 590 formed through cover 580 and groove 565. As depicted in FIG. 5A, wire routing apparatus 500 includes a single groove 565 that extends parallel to the longitudinal axis of the tubular body 510, having a first end 501 and second end 502. Aperture 590 is formed through groove 565 of tubular body 510 providing communication between groove 565 and central bore 515. Accordingly, a wire received in groove 565 may be routed through aperture 590 into the central bore 515 of tubular body 510 without the need of a port.

Figure 5A:
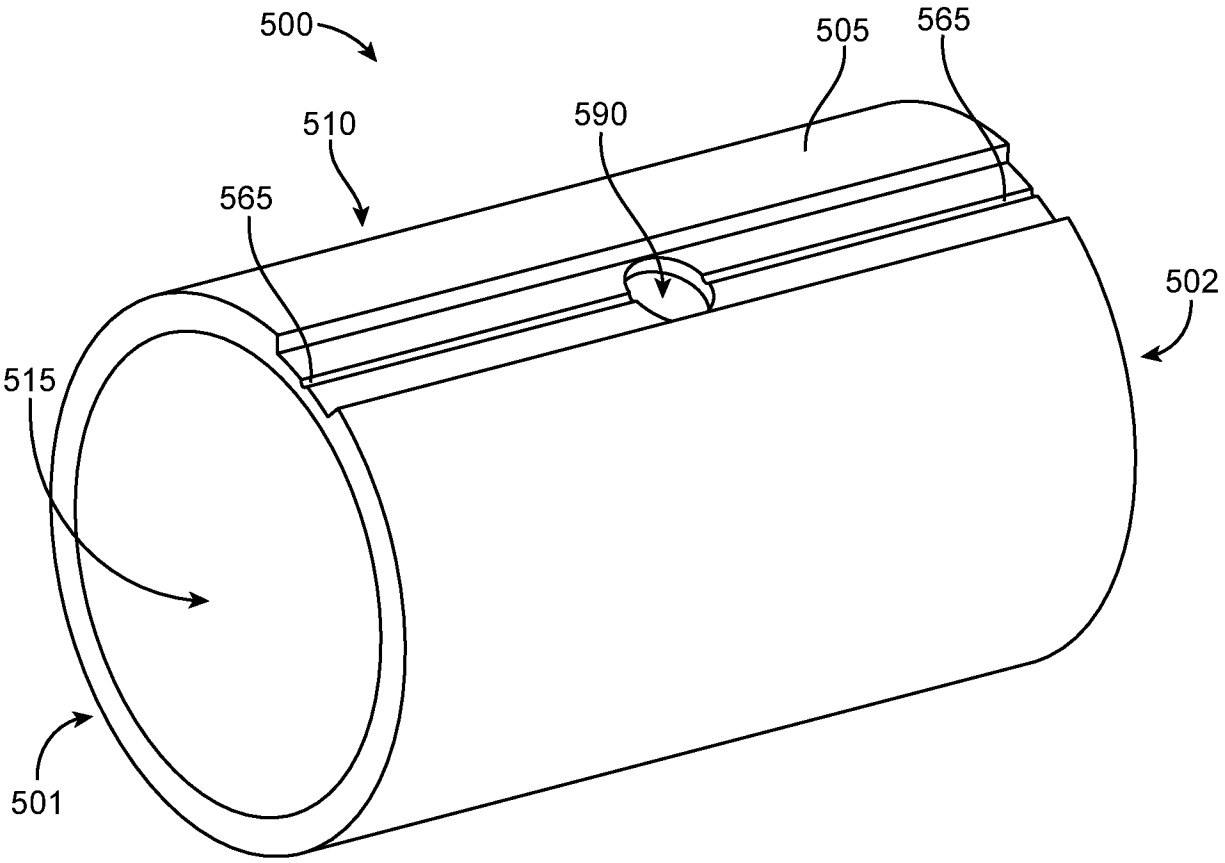
FIG. 5A illustrates a perspective view of a tubular body of a wire routing apparatus that includes a single groove that extends parallel to the longitudinal axis of the tubular body, according to an exemplary embodiment.
Figure 5B:
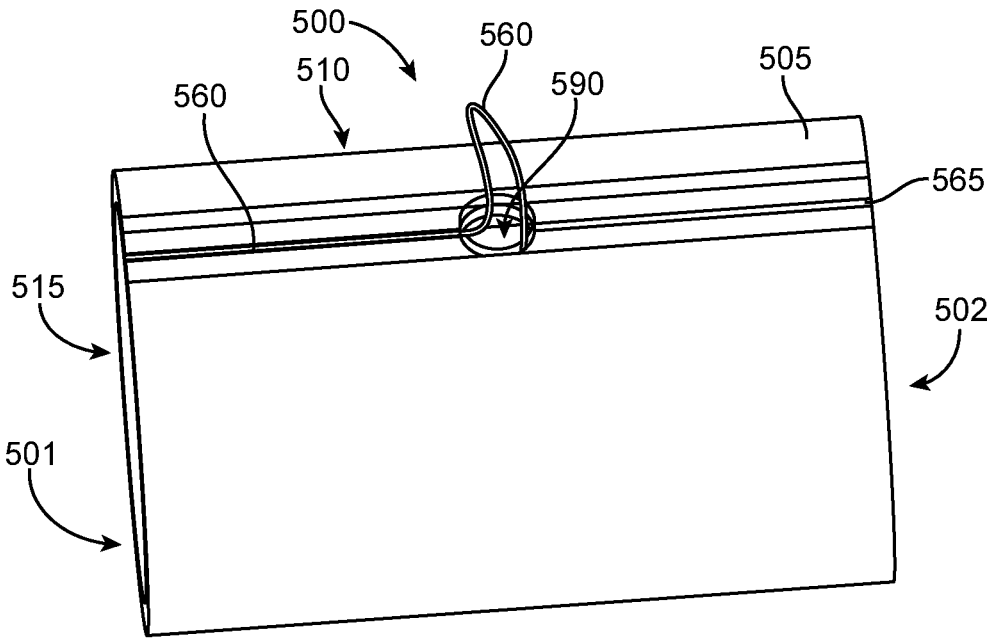
FIG. 5B illustrates a perspective view of a tubular body of a wire routing apparatus having a wire received in a groove, according to an exemplary embodiment.

FIG. 5B illustrates a perspective view of tubular body 510 of wire routing apparatus 500 having a wire 560 received in groove 565. As depicted in FIG. 5B, wire 560 extends from the first end 501 of tubular body 510 toward the second end 502 before entering through aperture 590 into the central bore 515 of tubular body 510.

Figure 5C:
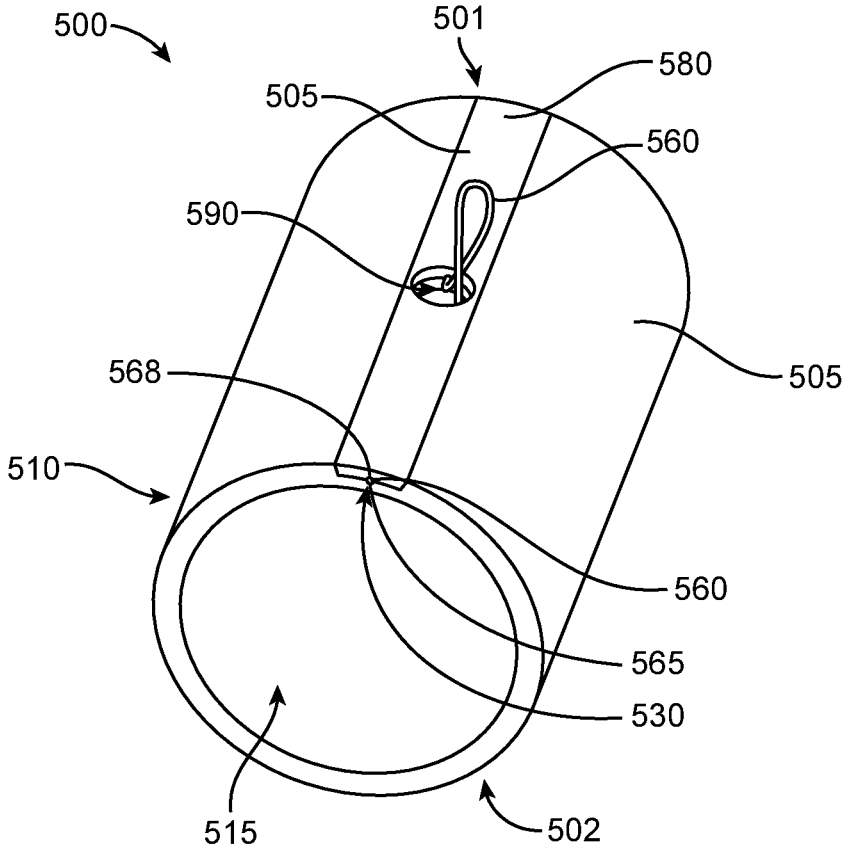
FIG. 5C illustrates a perspective view of a tubular body of a wire routing apparatus having a cover installed to form a portion of the outer circumferential surface of the tubular body, according to an exemplary embodiment.

FIG. 5C illustrates a perspective view of tubular body 510 of wire routing apparatus 500 having cover 580 installed to form a portion of the outer circumferential surface 505 of tubular body 510. As depicted in FIG. 5C, channel 230 is formed by groove 565 and groove 568 formed on cover 580. Channel 530, formed by grooves 565, 568, is disposed within tubular body 510 between the central bore 515 and the outer circumferential surface 505 of the tubular body 510. Channel 530 extends parallel to the longitudinal axis of the tubular body 510.

Aperture 590 is formed through cover 580 providing access to one or more wires received in channel 530 as well as any wires, such as tool wires, that may be present in the central bore 515 of tubular body 510. As such, an additional aperture adjacent to the channel 530 and/or cover 580 may not be required to couple wire 560, received in channel 530, with tool wires or a tool disposed in tubular body 510.

Figure 5D:
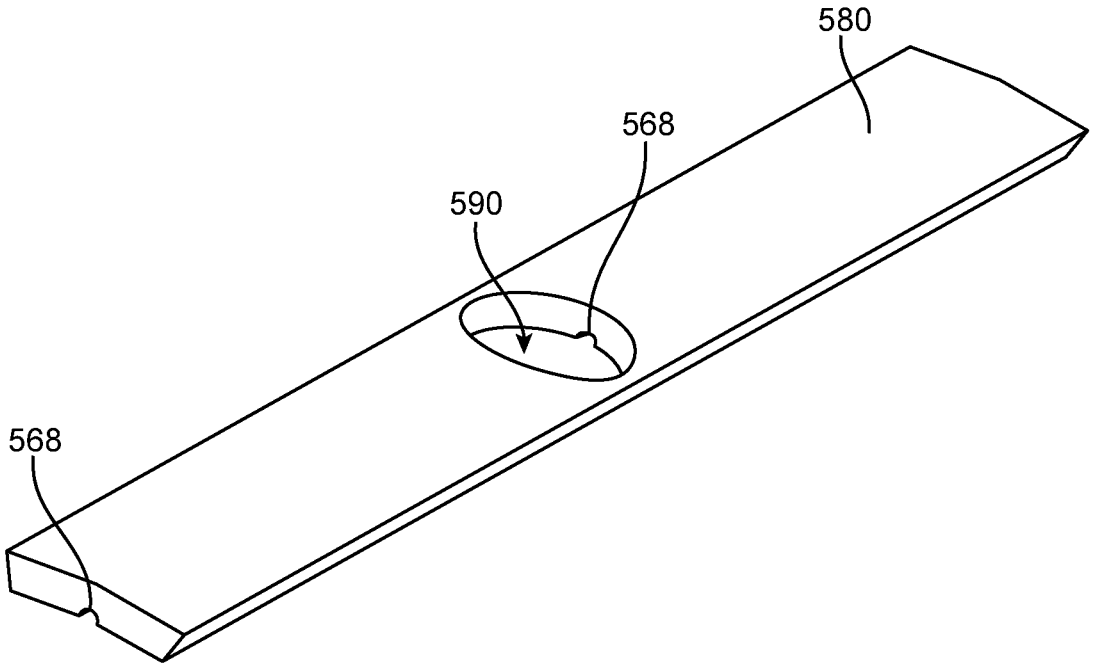
FIG. 5D illustrates a top perspective view of a cover prior to installation on the rest of the tubular body and having a groove and aperture formed thereon, according to an exemplary embodiment.
Figure 5E:
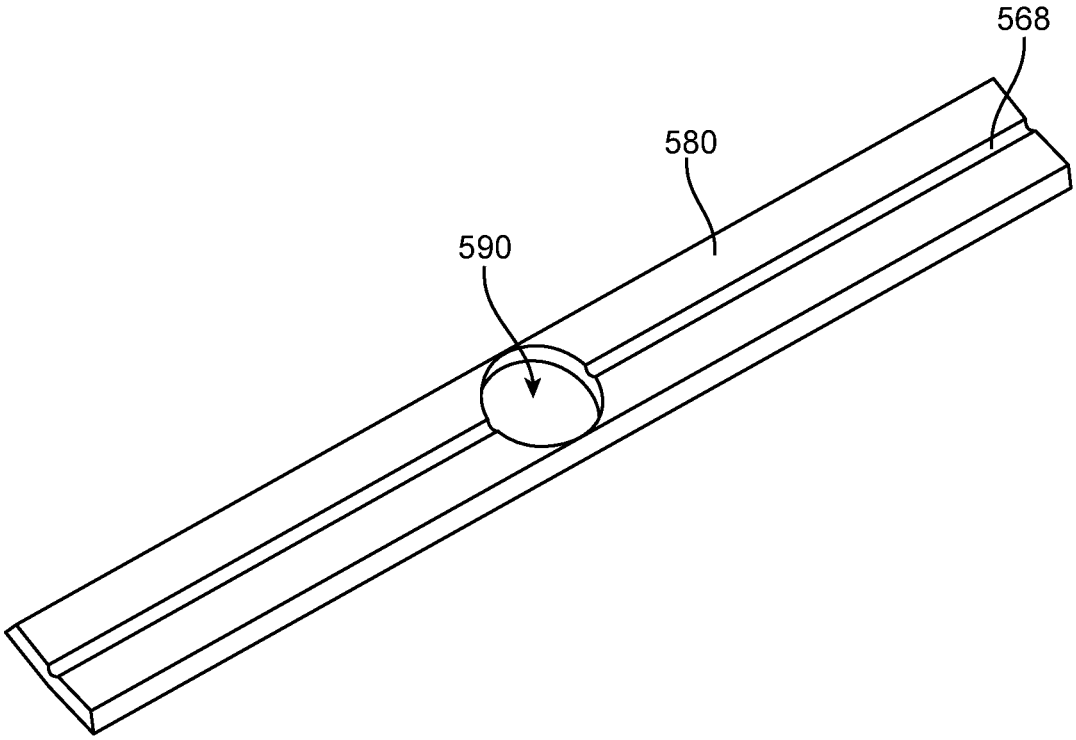
FIG. 5E illustrates a bottom perspective view of a cover having a groove extending parallel to the longitudinal axis of the cover, except for an aperture formed through the cover and groove, according to an exemplary embodiment.

FIG. 5D illustrates a top perspective view of cover 580, prior to installation on the rest of tubular body 510, having groove 568 and aperture 590 formed thereon. FIG. 5E illustrates a bottom perspective view of cover 580 having groove 568 extending parallel to the longitudinal axis of cover 580, except for aperture 590 formed through cover 580 and groove 568.

Figure 5F:
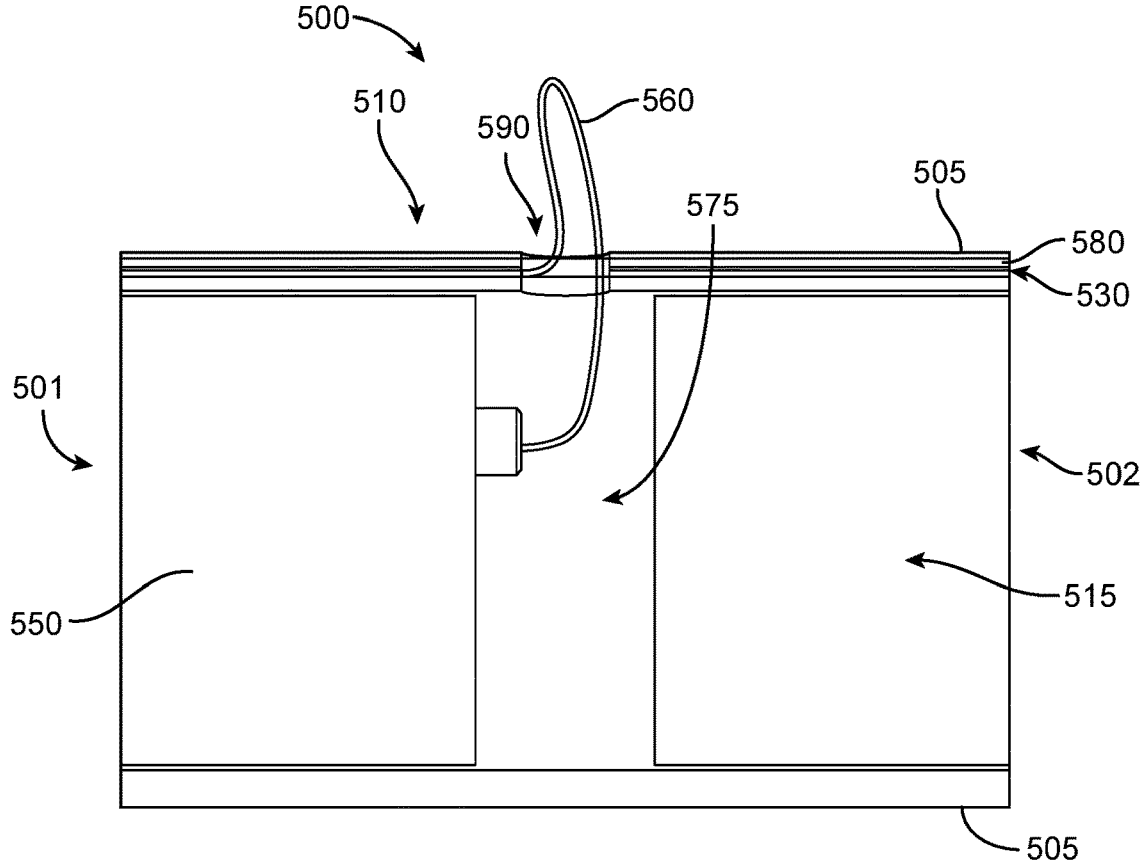
FIG. 5F illustrates a cross-sectional view of a wire routing apparatus having a downhole tool disposed in a tubular body, according to an exemplary embodiment.

FIG. 5F illustrates a cross-sectional view of wire routing apparatus 500 having a downhole tool 550 disposed in tubular body 510. As depicted in FIG. 5F, wire 560 received in channel 530 is routed into the central bore 515 of tubular body 510 through aperture 590 disposed in cover 580. Wire 560 may be coupled directly with downhole tool 550, as shown in FIG. 5F, or coupled with one or more tool wires that are in turn coupled with downhole tool 550.

Figure 5G:
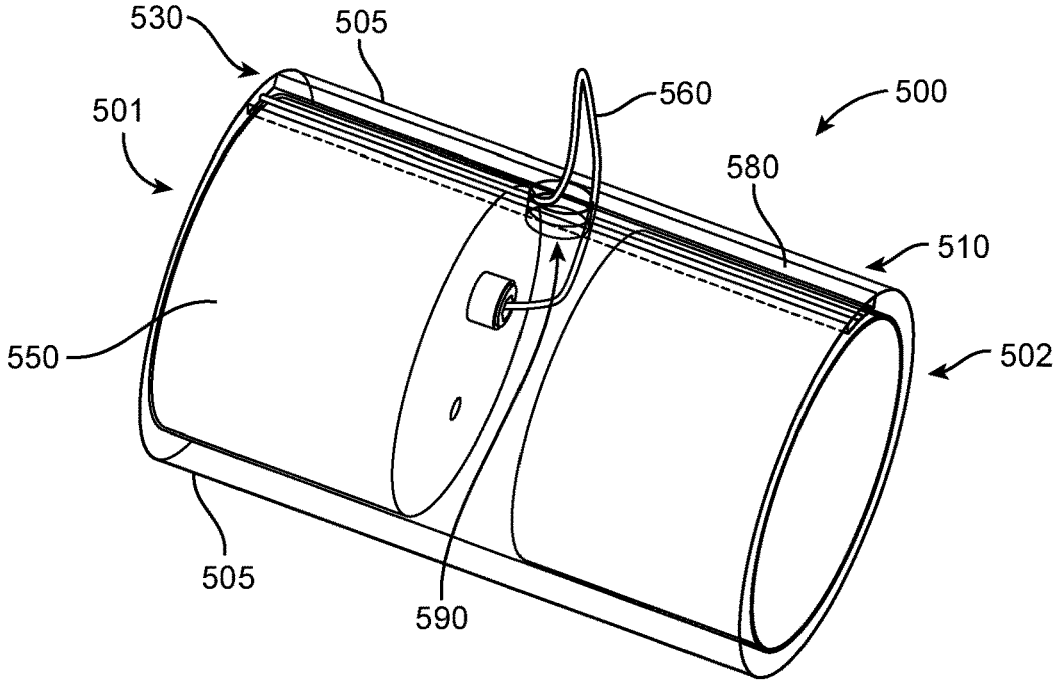
FIG. 5G illustrates a cross-sectional perspective view of a wire routing apparatus having a wire routed from a first end of a tubular body, through a channel disposed within the tubular body between the central bore and the outer circumferential surface of the tubular body, according to an exemplary embodiment.

FIG. 5G illustrates a cross-sectional perspective view of wire routing apparatus 500 having a wire 560 routed from a first end 501 of tubular body 510, through channel 530 disposed within tubular body 510 between the central bore 515 and the outer circumferential surface 505 of the tubular body 510. As depicted in FIG. 5G, wire 560 is routed through sealable aperture 590, disposed in cover 580, and coupled with downhole tool 550.

Figure 5H:
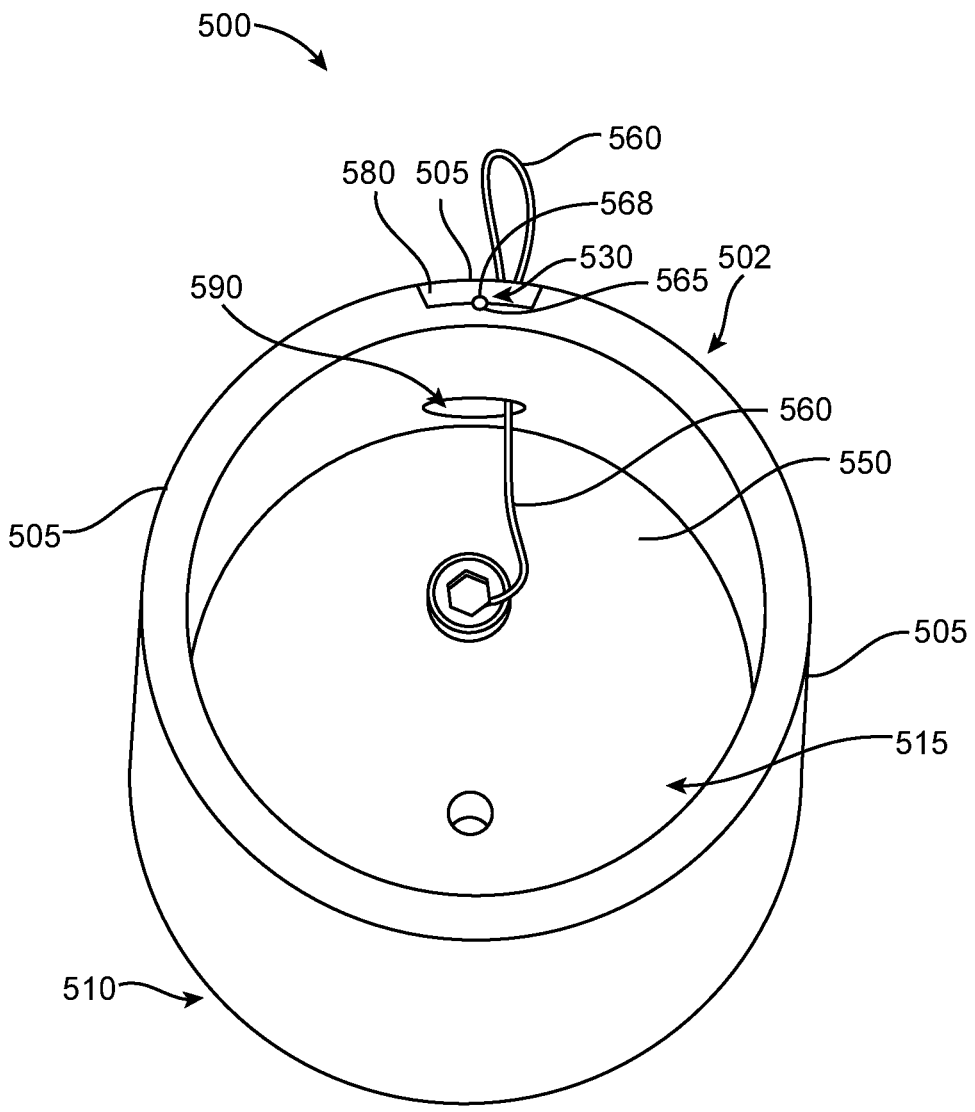
FIG. 5H illustrates a perspective end view of the second end of a wire routing apparatus having a channel disposed within a tubular body between the central bore and the outer circumferential surface of the tubular body, according to an exemplary embodiment.

FIG. 5H illustrates a perspective end view of the second end 502 of wire routing apparatus 500 having channel 530 disposed within tubular body 510 between the central bore 515 and the outer circumferential surface 505 of the tubular body 510. As depicted in FIG. 5H, channel 530 is formed by grooves 565, 568. Cover 580 forms a portion of outer circumferential surface 505. Wire 560 is depicted in FIG. 5H entering the central bore 515 of tubular body 510 through sealable aperture 590, formed in cover 580 and groove 565, and coupled with downhole tool 550.

As depicted in FIGS. 5B-C and 5F-H, wire 560 may be looped from central bore 515 through aperture 590 to outside outer circumferential surface 505 of tubular body 510. Thus, aperture 590 may provide sufficient access to wire 560 and central bore 515 so as to enable an operator to couple wire 560 with downhole tool 550 or tool wires (not shown). During downhole use of wire routing apparatus 500, wire 560 may be stored within central bore 515, for example, in wire storage chamber 575. Sealable aperture 590 may be sealed with a suitable plug during use of wire routing apparatus 500.

Although wire routing apparatus 500 is shown in FIGS. 5A-5H as having a single channel 530 disposed within tubular body 510 between the central bore 515 and the outer circumferential surface 505 of tubular body 510, wire routing apparatus 500 may include any number of channels 530, each formed by one or more grooves, without departing from the spirit and scope of the present disclosure.

Figure 5I:
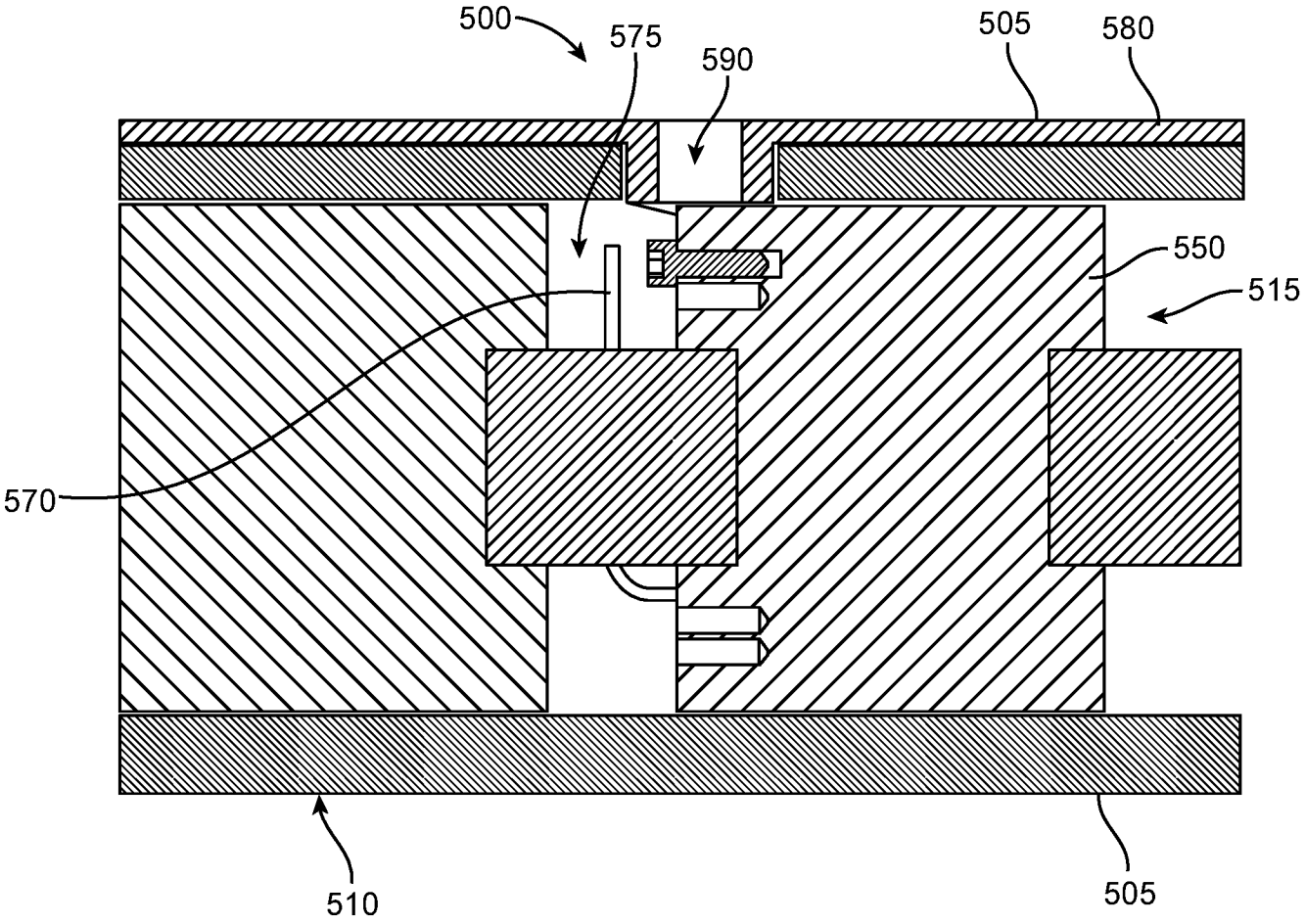
FIG. 5I illustrates a cross-sectional view of a wire routing apparatus having a sealable aperture that provides sufficient access to the central bore of the tubular body to allow for coupling of a wire to a tool wire coupled with a downhole tool, according to an exemplary embodiment.

While wire 560 is shown in FIGS. 5F-H as directly coupled with downhole tool 550, wire 560 may be coupled with downhole tool 550 by, for example, coupling wire 560 with a tool wire 570 coupled with downhole tool 550, as shown for example in FIG. 5I. As shown in FIG. 5I, sealable aperture 590 may provide sufficient access to central bore 515 of tubular body 510 to provide for coupling of a wire, such as wire 560, to tool wire 570 coupled with downhole tool 550.

Figure 6:
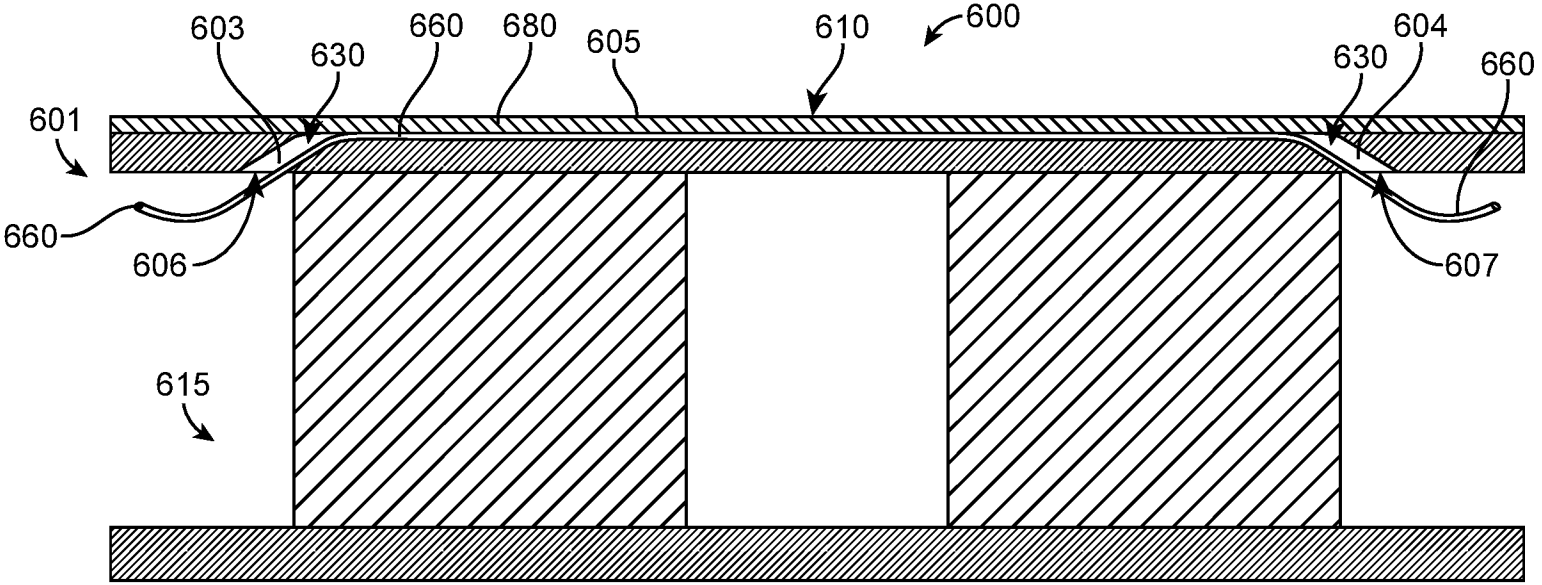
FIG. 6 illustrates a cross-sectional view of a wire routing apparatus that includes one or more channels having one or more ends that connect to the central bore of the tubular body.

According to at least one aspect of the present disclosure, the wire routing apparatus, discussed above with respect to FIGS. 2-5, may include one or more channels having one or more ends that connect to the central bore of the tubular body. For example, FIG. 6 illustrates a cross-sectional view of a wire routing apparatus 600 that includes a channel 630 disposed within the tubular body 610 between the central bore 615 and the outer circumferential surface 605. As depicted in FIG. 6, channel 630 has a first end 603 and a second end 604. The first end 603 of channel 630 has an opening 606 that provides an entry or exit path for one or more wires 660 received therein. Thus, opening 606 connects the first end 603 of the channel 630 to the central bore 615 of the tubular body 610 so that an end of wire 660 may be routed into the tubular body 610 through the central bore 615. As depicted in FIG. 6, cover 680 forms a portion of outer circumferential surface 605 of tubular body 610. Cover 680 also forms an upper portion of channel 630.

Similarly, the second end 604 of channel 630 has an opening 607 that provides an entry or exit path for one or more wires 660 received in channel 630. The opening 607 connects the second end 604 of the channel 630 to the central bore 615 of the tubular body 610 so that an end of wire 660 may be routed into the tubular body 610 through the central bore 615.

The openings 606, 607 of the channel 630 may be inset some distance from the end 601 of the tubular body 610 in order to accommodate a joint or other connecting member to couple with the end 601 of the tubular body 610. As depicted in FIG. 6, the ends 603, 604 of the channel 630 may be angled or tapered which helps maintain a seal between channel 630 and the environment exterior to the tubular body 610.

Figure 7:
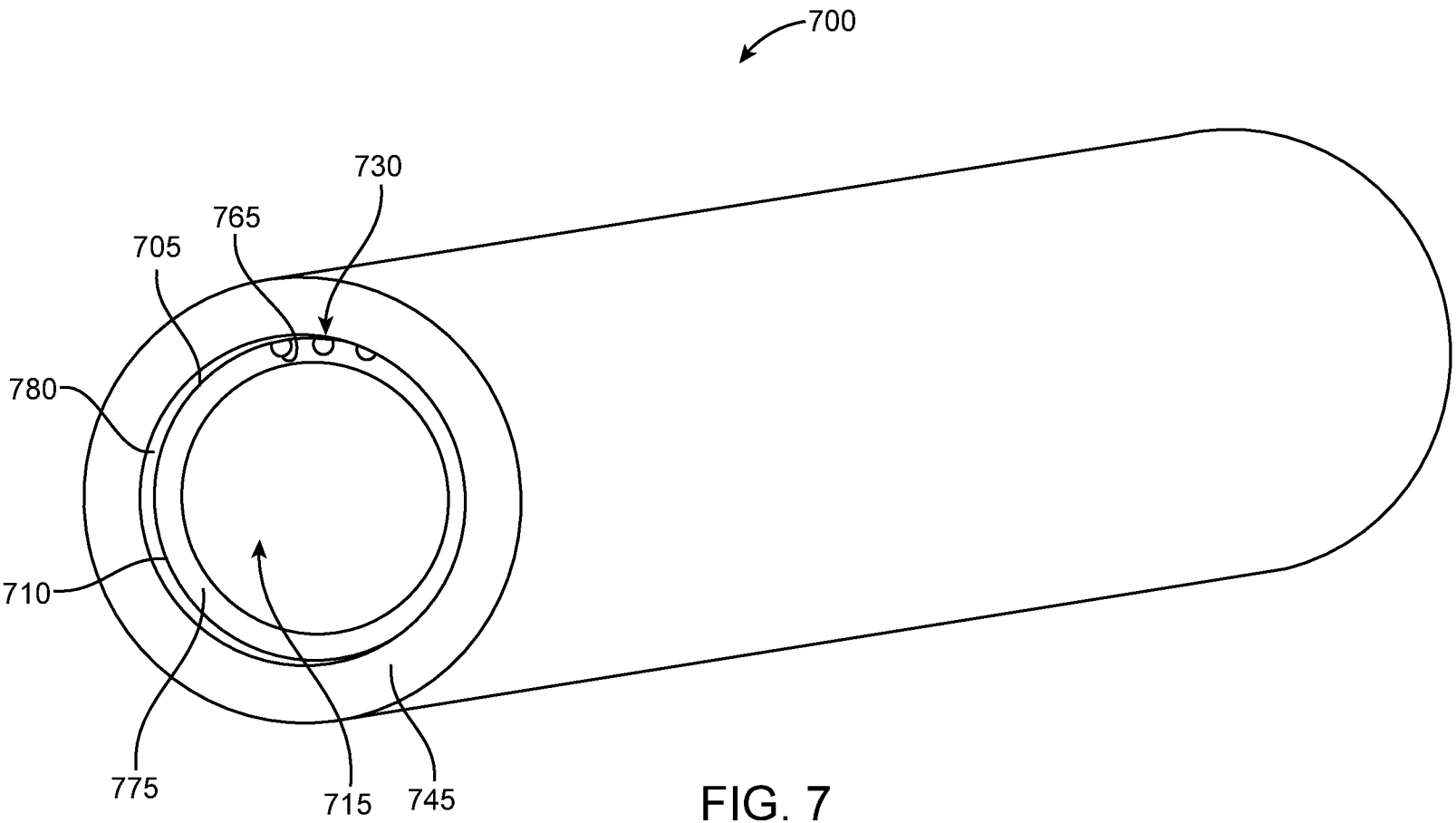
FIG. 7 illustrates an alternative wire routing apparatus that includes a first tubular body and a second tubular body, according to an exemplary embodiment.

FIG. 7 illustrates an alternative wire routing apparatus 700, according to at least one aspect of the present disclosure, that includes a first tubular body 745 and a second tubular body 775. As depicted in FIG. 7, the first tubular body 745 has a central bore 710 extending along a longitudinal axis and having an inner circumferential surface 780. The first tubular body 745 is capable of receiving a second tubular body 775 within the inner circumferential surface 780 of first central bore 710.

The second tubular body 775, disposed in the central bore 610 of the first tubular body 745, has a central bore 715 extending along a longitudinal axis. The second tubular body 775 includes an outer circumferential surface 705. The second tubular body 775 further includes grooves 765, parallel to the longitudinal axis, disposed on a portion of the outer circumferential surface 705. The grooves 765 and the inner circumferential surface 780 of the first tubular body together form channels 730. Channels 730 are capable of receiving one or more wires.

As depicted in FIG. 7, wire routing apparatus 700 includes three grooves 765 and three channels 730. However, the wire routing apparatus 700 may include any number of grooves or channels without departing from the spirit and scope of the present disclosure. For example, wire routing apparatus 700 may include just one groove, corresponding to a single channel. In other cases, wire routing apparatus 700 may include two, three, four, five, six, or more grooves, corresponding to the same number of channels capable of receiving a wire.

According to at least one aspect of the present disclosure, the inner circumferential surface 780 of the first tubular body 745 abuts the outer circumferential surface 705 of the second tubular body 775 to form one or more channels 730 capable of receiving one or more wires.

According to at least one aspect of the present disclosure, the presently disclosed wire routing apparatus, method, and system provides for more usable space within the central bore of the tubular body for downhole tools and components by routing downhole wires between the central bore and outer circumferential surface of the tubular body. As a result, the overall tool length of many downhole tools may be shortened when utilizing the presently disclosed apparatus, method, and system. Additionally, adapters and connectors specifically designed for routing wires can be eliminated. Further, wire service loops conventionally used to manage and prevent downhole wires from tangling may be eliminated. As wire service loops typically accommodate wire movement that may result in wire wear, the elimination of wire service loops may provide for greater tool reliability.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that a system including either one member of the set, or multiple members of the set, or all members of the set, satisfies the claim.

Statements of the Disclosure Include:

Statement 1: An apparatus comprising: a tubular body having a central bore extending along a longitudinal axis and having an outer circumferential surface; the tubular body comprising one or more grooves, parallel to the longitudinal axis, disposed within the tubular body between the central bore and outer circumferential surface, wherein the one or more grooves forms at least a portion of one or more channels capable of receiving one or more wires; wherein each of the one or more channels has a first end and a second end, at least one of the first end and the second end having an opening so as to provide an entry or exit path for a wire received therein.

Statement 2: An apparatus according to Statement 1, wherein the tubular body further comprises a cover forming a portion of the outer circumferential surface of the tubular body and forming an upper portion of the one or more channels.

Statement 3: An apparatus according to Statement 2, wherein the cover comprises grooves that form the upper portion of the one or more channels.

Statement 4: An apparatus according to any one of the preceding Statements 1-3, further comprising a downhole tool coupled with the tubular body.

Statement 5: An apparatus according to Statement 4, wherein the downhole tool is disposed within the central bore of the tubular body.

Statement 6: An apparatus according to any one of the preceding Statements 1-5, further comprising one or more wires received in the one or more channels.

Statement 7: An apparatus according to any one of the preceding Statements 1-6, wherein the tubular body further comprises a port between the one or more channels and the central bore, the port providing a path for the one or more wires received in the one or more channels to enter the central bore.

Statement 8: An apparatus according to Statement 7, wherein the port is a sloped port.

Statement 9: An apparatus according to any one of the preceding Statements 1-8, wherein the tubular body further comprises a sealable aperture disposed on the circumferential surface of the tubular body, the aperture providing communication between the central bore and the circumferential surface.

Statement 10: An apparatus according to Statement 9, wherein the sealable aperture is substantially adjacent to the cover.

Statement 11: An apparatus according to Statement 9, wherein the sealable aperture is disposed on the cover and is formed through one or more of the grooves.

Statement 12: An apparatus according to any one of the preceding Statements 9-11, wherein the sealable aperture is perpendicular to the longitudinal axis of the tubular body.

Statement 13: An apparatus according to any one of the preceding Statements 1-12, wherein the central bore of the tubular body comprises a wire storage chamber and the port provides a communication path between the wire storage chamber and the one or more channels.

Statement 14: An apparatus according to Statement 13, wherein the wire storage chamber is in further communication with the sealable aperture.

Statement 15: An apparatus according to any one of the preceding Statements 4-14, wherein the downhole tool is selected from the group consisting of a sliding sleeve assembly, a fluid or core sampling device, a setting tool, a logging tool, a wellbore isolation device, a fishing tool, a milling tool, a drilling tool, a reamer, a packer, a perforating tool, a bridge plug, a motor, a clutch, a downhole sensor, a valve, and an actuation device.

Statement 16: An apparatus according to any one of the preceding Statements 6-15, wherein the one or more wires are configured to transmit one of electrical power, telemetry data, and a control signal.

Statement 17: An apparatus according to any one of the preceding Statements 1-16, wherein the tubular body further comprises a plurality of covers, each cover forming a portion of the outer circumferential surface of the tubular body and forming an upper portion of the one or more channels.

Statement 18: An apparatus according to any one of the preceding Statements 1-17, further comprising one or more additional tubular bodies coupled with the tubular body, wherein each of the additional tubular bodies comprises one or more channels disposed within the additional tubular body between the central bore and outer circumferential surface of the additional tubular body, each of the one or more channels capable of receiving one or more wires.

Statement 19: An apparatus according to any one of the preceding Statements 6-18, wherein the wire is coupled with the downhole tool.

Statement 20: An apparatus according to any one of the preceding Statements 1-19, wherein the tubular body comprises the housing of a downhole tool.

Statement 21: An apparatus according to any one of the preceding Statements 1-20, wherein the opening of the end of the channel is disposed about the central bore of the tubular body, so as to provide communication between the channel and the central bore of the tubular body.

Statement 22: A method comprising: deploying a downhole tool within a wellbore, wherein the downhole tool is coupled with at least one tubular body, the tubular body having a central bore extending along a longitudinal axis and having an outer circumferential surface; routing a wire through at least one tubular body to the downhole tool, wherein at least a portion of the wire is disposed within the at least one tubular body between the central bore and the outer circumferential surface; and transmitting through the wire one of electrical power, telemetry data, and a control signal.

Statement 23: A method according to Statement 22, wherein the wire is routed to the downhole tool from an oilfield surface adjacent the well.

Statement 24: A method according to Statement 22, wherein the wire is routed to the downhole tool from a downhole computing device.

Statement 25: A method according to any one of the preceding Statements 22-24, wherein the downhole tool is selected from the group consisting of a sliding sleeve assembly, a fluid or core sampling device, a setting tool, a logging tool, a wellbore isolation device, a fishing tool, a milling tool, a drilling tool, a reamer, a packer, a perforating tool, a bridge plug, a motor, a clutch, a downhole sensor, a valve, and an actuation device.

Statement 26: A method according to any one of the preceding Statements 22-25, wherein the wire is routed through one or more channels disposed in the tubular body between the central bore and the outer circumferential surface.

Statement 27: A method according to any one of the preceding Statements 22-26, wherein the wire is routed through one or more grooves disposed in the tubular body between the central bore and the outer circumferential surface.

Statement 28: A method according to any one of the preceding Statements 22-27, further comprising routing a plurality of wires through the tubular body, wherein at least a portion of the wire is disposed within the at least one tubular body between the central bore and the outer circumferential surface.

Statement 29: A method according to any one of the preceding Statements 22-28, wherein the downhole tool is disposed within the central bore of at least one tubular body.

Statement 30: A method according to any one of the preceding Statements 26-29, wherein the wire is further routed to the downhole tool through a port providing communication between the one or more channels and the central bore.

Statement 31: A method according to any one of the preceding Statements 26-30, further comprising flowing hydraulic fluid through the one or more channels.

Statement 32: A method according to Statement 31, wherein the flowing hydraulic fluid comprises flowing hydraulic fluid between the wires routed through the one or more channels and the walls of the channel in order to equalize the pressure within the channels so as to increase the survivability and service life of the wire.

Statement 33: A method according to Statement 32, further comprising performing at least one downhole tool operation.

Statement 34: A system comprising: a downhole tool provided in a wellbore; a tubular body coupled with the downhole tool, the tubular body having a central bore extending along a longitudinal axis and having an outer circumferential surface; the tubular body comprising one or more grooves, parallel to the longitudinal axis, disposed within the tubular body between the central bore and outer circumferential surface, wherein the one or more grooves forms at least a portion of one or more channels capable of receiving one or more wires; wherein each of the one or more channels has a first end and a second end, at least one of the first end and the second end having an openingso as to provide an entry or exit path for a wire received therein.

Statement 35: A system according to Statement 34, wherein the tubular body further comprises a cover forming a portion of the outer circumferential surface of the tubular body and forming an upper portion of the one or more channels.

Statement 36: A system according to Statement 34, wherein the cover comprises grooves that form the upper portion of the one or more channels.

Statement 37: A system according to any one of the preceding Statements 34-36, wherein the downhole tool is disposed within the central bore of the tubular body.

Statement 38: A system according to any one of the preceding Statements 34-37, further comprising one or more wires received in the one or more channels and coupled with the downhole tool.

Statement 39: A system according to Statement 38, wherein the one or more wires are configured to transmit one of electrical power, telemetry data, and a control signal.

Statement 40: A system according to Statement 38 or Statement 39, wherein the tubular body further comprises a port between the one or more channels and the central bore, the port providing a path for the one or more wires received in the one or more channels to enter the central bore.

Statement 41: A system according to Statement 40, wherein the port is a sloped port.

Statement 42: A system according to any one of the preceding Statements 34-41, wherein the tubular body further comprises a sealable aperture disposed on the circumferential surface of the tubular body, the aperture providing communication between the central bore and the circumferential surface.

Statement 43: A system according to Statement 42, wherein the sealable aperture is substantially adjacent to the cover.

Statement 44: A system according to Statement 42, wherein the sealable aperture is disposed on the cover and is formed through one or more of the grooves.

Statement 45: A system according to any one of the preceding Statements 42-44, wherein the sealable aperture is perpendicular to the longitudinal axis of the tubular body.

Statement 46: A system according to any one of the preceding Statements 40-45, wherein the central bore of the tubular body comprises a wire storage chamber and the port provides a communication path between the wire storage chamber and the one or more channels.

Statement 47: A system according to Statement 46, wherein the wire storage chamber is in further communication with the sealable aperture.

Statement 48: A system according to any one of the preceding Statements 34-47, wherein the downhole tool is selected from the group consisting of a sliding sleeve assembly, a fluid or core sampling device, a setting tool, a logging tool, a wellbore isolation device, a fishing tool, a milling tool, a drilling tool, a reamer, a packer, a perforating tool, a bridge plug, a motor, a clutch, a downhole sensor, a valve, and an actuation device.

Statement 49: A system according to any one of the preceding Statements 34-48, wherein the tubular body further comprises a plurality of covers, each cover forming a portion of the outer circumferential surface of the tubular body and forming an upper portion of the one or more channels.

Statement 50: A system according to any one of the preceding Statements 34-49, further comprising one or more additional tubular bodies coupled with the tubular body, wherein each of the additional tubular bodies comprises one or more channels disposed within the additional tubular body between the central bore and outer circumferential surface of the additional tubular body, each of the one or more channels capable of receiving one or more wires.

Statement 51: A system according to any one of the preceding Statements 34-50, wherein the tubular body comprises the housing of a downhole tool.

Statement 52: A system according to any one of the preceding Statements 38-51, wherein the wire is coupled with the downhole tool.

Statement 53: A system according to any one of the preceding Statements 34-52, wherein the opening of the end of the channel is disposed about the central bore of the tubular body, so as to provide communication between the channel and the central bore of the tubular body.

Statement 54: An apparatus comprising: a first tubular body having a first central bore extending along a longitudinal axis and having an inner circumferential surface; a second tubular body disposed in the first central bore of the first tubular body, the second tubular body having a second central bore extending along a longitudinal axis and having an outer circumferential surface, the second tubular body comprising one or more grooves, parallel to the longitudinal axis, disposed on a portion of the outer circumferential surface of the second tubular body, wherein the one or more grooves forms at least a portion of one or more channels capable of receiving one or more wires.

Statement 55: An apparatus according to Statement 54, wherein the inner circumferential surface of the first tubular body abuts the outer circumferential surface of the second tubular body to form one or more channels capable of receiving one or more wires.

Statement 56: An apparatus according to Statement 54 or Statement 55, further comprising a downhole tool coupled with the second tubular body.

Statement 57: An apparatus according to any one of the preceding Statements 54-56, wherein the downhole tool is disposed within the second central bore of the second tubular body.

Statement 58: An apparatus according to any one of the preceding Statements 54-57, further comprising one or more wires received in the one or more channels.

Statement 59: An apparatus according to any one of the preceding Statements 54-58, wherein the tubular body further comprises a port between the one or more channels and the second central bore, the port providing a path for the one or more wires received in the one or more channels to enter the second central bore.

Statement 60: An apparatus according to any one of the preceding Statements 54-59, wherein the port is a sloped port.

Statement 61: An apparatus according to any one of the preceding Statements 54-60, wherein the second central bore of the second tubular body comprises a wire storage chamber and the port provides a communication path between the wire storage chamber and the one or more channels.

Statement 62: An apparatus according to any one of the preceding Statements 56-61, wherein the downhole tool is selected from the group consisting of a sliding sleeve assembly, a fluid or core sampling device, a setting tool, a logging tool, a wellbore isolation device, a fishing tool, a milling tool, a drilling tool, a reamer, a packer, a perforating tool, a bridge plug, a motor, a clutch, a downhole sensor, a valve, and an actuation device.

Statement 63: An apparatus according to any one of the preceding Statements 58-62, wherein the one or more wires are configured to transmit one of electrical power, telemetry data, and a control signal.

Statement 64: An apparatus according to any one of the preceding Statements 58-63, wherein the wire is coupled with the downhole tool.

Statement 65: An apparatus according to any one of the preceding Statements 54-64, wherein either the first tubular body or the second tubular body comprises the housing of a downhole tool.

We claim:

1. An apparatus comprising:

a tubular body having a central bore extending along a longitudinal axis thereof and an outer circumferential surface having an indent formed therein, the tubular body further comprising:

a plurality of grooves formed along the surface of the indent and parallel to the longitudinal axis of the tubular body, wherein the plurality of grooves form a lower portion of a plurality of channels capable of receiving one or more wires therein, and a port formed in the tubular body between the outer circumferential surface and the central bore, the port providing a path for the one or more wires routed through the plurality of channels to enter the central bore;

a cover couplable with the tubular body and sized to cover the indent completing the outer circumferential surface, the cover having a plurality of secondary grooves which form an upper portion of the plurality of channels when the cover is coupled with the tubular body; and a downhole tool disposed within the central bore of the tubular body, wherein one or more wires are routed through one or more of the plurality of channels and coupled with the downhole tool through the port, wherein each of the plurality of channels has a first end and a second end, at least one of the first end and the second end having an opening so as to provide an entry or exit path for the one or more wires routed therethrough.

2. The apparatus according to claim 1, wherein the opening of the end of the channel is disposed about the central bore of the tubular body, so as to provide communication between the channel and the central bore of the tubular body.

3. The apparatus according to claim 2, wherein the tubular body further comprises a sealable aperture disposed on the outer circumferential surface of the tubular body, the aperture providing communication between the central bore and the outer circumferential surface.

4. The apparatus according to claim 3, wherein the central bore of the tubular body comprises a wire storage chamber and the port provides a communication path between the wire storage chamber and the plurality of channels, wherein the wire storage chamber is in further communication with the sealable aperture.

5. The apparatus according to claim 4, wherein the downhole tool is selected from the group consisting of a sliding sleeve assembly, a fluid or core sampling device, a setting tool, a logging tool, a wellbore isolation device, a fishing tool, a milling tool, a drilling tool, a reamer, a packer, a perforating tool, a bridge plug, a motor, a clutch, a downhole sensor, a valve, and an actuation device.

6. The apparatus according to claim 1, wherein the tubular body further comprises a plurality of indents each of the plurality of indents having one or more additional grooves formed along the surface of the indent and forming a lower portion of one or more secondary channels, and a plurality of covers sized to fit each of the plurality of indents, each cover forming a portion of the outer circumferential surface of the tubular body and having one or more additional secondary grooves forming an upper portion of the one or more secondary channels.

7. The apparatus according to claim 1, wherein the tubular body comprises the housing of a downhole tool.

8. The apparatus of claim 1, wherein the port is formed adjacent to the plurality of grooves of the tubular body.

9. The apparatus of claim 1, wherein the port is formed through at least one of the plurality of grooves of the tubular body.

10. The apparatus of claim 1, wherein the cover is coupled with the tubular body via one or more welds.

11. The apparatus of claim 1, wherein the one or more wires transmit one or more of electrical power, telemetry data, and control signal.

12. A method comprising:

deploying a downhole tool within a wellbore, wherein the downhole tool is coupled with at least one tubular body, having a central bore extending along a longitudinal axis thereof and an outer circumferential surface having an indent formed therein;

routing a wire through one of a plurality of channels formed between the indent of the tubular body and a cover couplable with the tubular body and sized to cover the indent completing the outer circumferential surface the plurality of channels are formed when the cover is coupled with the tubular body by a plurality of grooves formed along the surface of the indent of the outer circumferential surface and a plurality of secondary grooves formed in the cover; and transmitting through the wire one of electrical power, telemetry data, and a control signal.

13. The method of claim 12, wherein the wire is routed to the downhole tool from a downhole computing device.

14. The method of claim 12, the wire further routed to the downhole tool, disposed within the central bore of the at least one tubular body, through a port providing communication between the plurality of channels and the central bore.

15. The method of claim 12, further comprising flowing hydraulic fluid through the plurality of channels.

16. The method of claim 15, wherein flowing hydraulic fluid comprises flowing hydraulic fluid between the wires routed through the plurality of channels and the walls of the channel in order to equalize the pressure within the channels so as to increase the survivability and service life of the wire.

17. A system comprising:

a downhole tool deployed within a wellbore;

a tubular body coupled with the downhole tool, the tubular body having a central bore extending along a longitudinal axis thereof and an outer circumferential surface having an indent formed therein, the tubular body further comprising:

a plurality of grooves formed along the surface of the indent and parallel to the longitudinal axis of the tubular body, wherein the plurality of grooves forms a lower portion of a plurality of channels capable of receiving one or more wires therein, and a port formed in the tubular body between the outer circumferential surface and the central bore, the port providing a path for the one or more wires routed through the plurality of channels to enter the central bore, wherein each of the plurality of channels has a first end and a second end, at least one of the first end and the second end having an opening so as to provide an entry or exit path for a wire received therein;

a cover couplable with the tubular body and sized to cover the indent completing the outer circumferential surface, the cover having a plurality of secondary grooves which form an upper portion of the plurality of channels when the cover is coupled with the tubular body; and one or more wires routed through one or more of the plurality of channels and coupled with the downhole tool via the port, the one or more wires configured to transmit one of electrical power, telemetry data, and a control signal.

18. The system according to claim 17, wherein the downhole tool is disposed within the central bore of the tubular body, the downhole tool selected from the group consisting of a sliding sleeve assembly, a fluid or core sampling device, a setting tool, a logging tool, a wellbore isolation device, a fishing tool, a milling tool, a drilling tool, a reamer, a packer, a perforating tool, a bridge plug, a motor, a clutch, a downhole sensor, a valve, and an actuation device.

19. The system according to claim 18, wherein the tubular body further comprises a plurality of covers, each cover sized to fit one of a plurality of indents formed in the tubular body.

* * * * *